US006772564B2

(12) United States Patent
Leon

(10) Patent No.: US 6,772,564 B2
(45) Date of Patent: Aug. 10, 2004

(54) UNITIZED, PRE-FABRICATED RAISED ACCESS FLOOR ARRANGEMENT, INSTALLATION AND LEVELING METHOD, AND AUTOMATIZED LEVELING TOOL

(76) Inventor: Richard Joseph Leon, 900 W. Bitner Rd., Park City, UT (US) 84098

( * ) Notice: Subject to any disclaimer, the term of this patent is extended or adjusted under 35 U.S.C. 154(b) by 54 days.

(21) Appl. No.: 10/193,510

(22) Filed: Jul. 11, 2002

(65) Prior Publication Data

US 2003/0051420 A1 Mar. 20, 2003

Related U.S. Application Data

(60) Provisional application No. 60/324,869, filed on Sep. 27, 2001, and provisional application No. 60/304,719, filed on Jul. 11, 2001.

(51) Int. Cl.[7] ..... E04B 9/00

(52) U.S. Cl. ..... 52/126.5; 52/126.6; 52/263

(58) Field of Search ..... 52/126.5, 126.6, 52/263, 122.1, 123.1, 126.1, 126.2, 126.3, 126.4, 126.7, 125.1, 125.2, 261, 262, 264, 265, 266, 267–271

(56) References Cited

U.S. PATENT DOCUMENTS 3,811,237 A * 5/1974 Bettinger ..... 52/126.6
4,558,544 A * 12/1985 Albrecht et al. ..... 52/126.6
4,561,232 A * 12/1985 Gladden et al. ..... 52/385
4,578,910 A * 4/1986 Germeroth et al. ..... 52/105
4,870,789 A * 10/1989 Clark et al. ..... 52/126.6
4,914,875 A * 4/1990 Gustafson ..... 52/126.6
4,942,708 A * 7/1990 Krumholz et al. ..... 52/263
4,996,804 A * 3/1991 Naka et al. ..... 52/126.6
5,025,598 A * 6/1991 Manna et al. ..... 52/126.6
5,333,423 A * 8/1994 Propst ..... 52/126.6
5,363,610 A * 11/1994 Thomas et al. ..... 52/167.8
5,791,096 A * 8/1998 Chen ..... 52/126.6
5,979,116 A * 11/1999 Myoga ..... 52/8
6,202,374 B1 * 3/2001 Cooper et al. ..... 52/220.3
6,256,939 B1 * 7/2001 Snyder ..... 52/126.6
6,463,704 B1 * 10/2002 Jette ..... 52/125.2
6,519,902 B1 * 2/2003 Scissom ..... 52/126.4
6,550,195 B1 * 4/2003 Cooper et al. ..... 52/220.3
6,669,163 B2 * 12/2003 Davis, Jr. ..... 248/188.1

* cited by examiner

*Primary Examiner*—Jeanette Chapman
(74) *Attorney, Agent, or Firm*—Alberto A. León, Esq.; Bauman, Dow & León, P.C.

(57) ABSTRACT

The invention concerns a unitized access floor system, a method to install it, and automatized leveling tools. The access floor comprises an assembly of modular stringer frames joined to form a layout. Pedestals for vertical leveling of the modular stringer frame are attached to the stringer frame, or can be hinged to the stringer frame during manufacture, and can fold down from within the stringer frame to facilitate stacking, packaging and shipping from the factory. The primary automatized leveling tool involves a rotating driving female socket coinciding with the layout of the modular stringer frame, matting with the leveling pedestals. The automatized tool has a central motor with variable speeds and reversible independent gear drives or multiple motors. Modular stringer frames are leveled adjacent to each other forming a matrix comprising modular stringer frames which receive floor panels interlocking adjacent stringer frames.

11 Claims, 21 Drawing Sheets

BOTTOM VIEW OF CONCRETE FILLED
2' X 2' STEEL PANEL

PANELS (FP) AND (PP) ARE SHOWN ENLARGED IN FIGURES 12 AND 13 FOR CLARITY

UNITIZED, PRE-FABRICATED RAISED ACCESS FLOOR ARRANGEMENT, INSTALLATION AND LEVELING METHOD, AND AUTOMATIZED LEVELING TOOL

CLAIM OF DOMESTIC PRIORITY UNDER 35 U.S.C. 119(e)

Applicant hereby claims the benefit under 35 U.S.C. 119(e) of the following provisional patent applications:

1. Application Ser. No. 60/304,719 filed on Jul. 11, 2001, and
2. Application Ser. No. 60/324,869 filed on Sep. 27, 2001.

BACKGROUND OF THE INVENTION

1. Technical Field of the Invention

The invention relates generally to access floors, methods to assemble access floors and access floor leveling tools. This invention relates particularly to a unitized, pre-fabricated raised access floor system comprising stringer frames which can be joined to form multiple geometrical structures. Multiple leveling pedestals can be attached to the stringer frames to form Modules in the field or in the factory, with the pedestals being detachable, fixed to the stringer frames via retractable hinges, or both. The invention also relates to an automatic, computerized leveling tool.

2. Description of the Background Art

In the early days of computers and related technology, the equipment was commonly housed in so-called computer rooms, which were generally contained within the area of a work group. In order to maintain and maximize the utility of multiple large pieces of computer equipment within a confined space, it was necessary to provide power and electronic communication to and between each piece. The computer equipment of the early days generated large quantities of heat, thus requiring cooling equipment. The large amount of cabling had to be stored at floor level. Likewise, the supply of chilled air should ideally have originated at floor level. The abundant cabling became a physical impediment to computer room workers. The chilled air being forced into the room, generally from one or more wall or ceiling mounted diffusers, did not efficiently cool the equipment and resulted in working environments too cold for computer room workers. The advent of the raised floor, commonly referred to as computer room flooring, solved many of the problems caused by cabling and cooling requirements.

Early raised floors were basically crawl spaces built in place some distance above the primary floor ("subfloor") of the building. The raised floor was built within the boundaries of the computer room leaving the surrounding work areas available for general work functions. Areas which did not include desktop word or data processing usually were not fitted with access floors. Cabling could then be placed in the computer room in the space created between the subfloor and the raised floor. In the most common arrangements, the crawl space between the subfloor and the raised floor had removable hatches positioned in locations where cable connections occurred. Hatched openings in the raised floor were located above cable connections. Openings, for chilled air ducts to pass through, were positioned adjacent to computer equipment so that chilled air could be supplied close to each piece of equipment at floor level. As computer equipment and their layout within a computer room evolved, it became necessary for raised floor technology to evolve accordingly.

The early raised floor designs lacked versatility. That shortcoming brought about later improved designs which evolved in today's access floors. Access floors, in their current form, have been widely used for many years. Common access floors are two-feet square finished floor panels which sit on vertical panel corner pedestals at some uniform elevation above a subfloor. Each corner pedestal is usually shared by four 2 ft by 2 ft finish floor panels. The panels are screw-fastened to each corner pedestal. An alternate method of placing panels on pedestals utilizes horizontal structural members referred to as stringers, which commonly span three pedestals in two perpendicular directions. Once all pedestals are interconnected by stringers, i.e., screw-fastened to the pedestals, the 2 ft by 2 ft finish floor panels are placed on the matrix of stringers. The panels are either gravity-held on the stringers or screw-fastened to the stringers and pedestals. The space between the access floor and the subfloor can be utilized as a supply air plenum for heating, ventilating and air conditioning (HVAC).

An air diffuser grill can be inserted in a hole cut into certain panels allowing forced air into the plenum to flow up into the work space above the access floor. The forced air is generally supplied by a central HVAC plant. Every 2 ft by 2 ft panel of the access floor is removable, making the entire surface of the access floor accessible to the plenum. The plenum can serve as a chase way for all power, voice and data cabling at the same time it serves as the supply air plenum. Return air intake grills and ducts are located at ceiling elevation above the access floor.

Computer and communication applications now go beyond the computer rooms of the past. The modem information technology ("IT") worker is commonly equipped with a personal computer adapted for voice and data telecommunication across long distances between large numbers of people and facilities. The typical IT worker requires and usually occupies between 70 and 100 square feet of work space floor area. This is equivalent to an area made up of 25 two-foot square access floor panels. Each IT worker's work station requires electrical power for personal computer equipment which generally has integrated telecommunication equipment for voice and data transmission. Power supply, and voice and data cabling run bi-directionally between centralized computer rooms and IT workers within a facility.

Access floors are now more effective in the entire work space of all IT workers and centralized computer rooms. The high occupancy density of contemporary IT work space, typically 200 to 300 IT workers per building floor, approximately 25,000 square feet, requires intense use and long runs of power, voice and data cabling. The high human occupancy associated with equal numbers of personal computers increases building heat loads requiring greater demands for air-conditioning. In spite of the increased air-conditioning requirements of today's office buildings, the contemporary access floor is essentially the same floor which was primarily utilized in early computer rooms.

Access floors are now installed in expansive areas far beyond computer rooms throughout entire buildings. Access floor manufacturing involves many separate parts and pieces requiring labor intense assembly in the field in far less than ideal work conditions. The installation of contemporary access floors, if not planned and scheduled meticulously, can have a significant negative impact on building construction. By the nature of the work involved, the installation of access floors directly affects the construction sequencing, scheduling, and cost. The finished floor panels used in contemporary access floors are manufactured with heavy weight materials, which add significantly to the handling and shipping cost, and logistics. The air diffusers used in connection with access floors are difficult to install and adjust, and usually do not satisfy both machine and human air diffusion and cooling requirements.

Access floors were originally designed for the specific application of providing raised floors in computer rooms. A 2,500 square foot computer room can support approximately 850 IT workers occupying 85,000 square feet of other work space floor area. Nonetheless, due to the lack of innovations in the access floor technology, today's access floors still require construction industry skills and methods that only allow the efficient installation of a relatively small number of floors in relatively small, specialized areas of buildings. State of the art computer applications, however, demand large quantities of access flooring in expansive areas of larger buildings. This demand is only expected to increase in years to come. Where today's access floor technology, including installation, may be appropriate for a relatively small single room area, it can be dismal for large expansive installations.

For example, approximately 5,900 separate components and fasteners are required to install a commonly used access floor in a 2,500 square foot computer room. In today's office and industrial complexes, it is not unusual to encounter a computer room supporting 850 IT workers and occupying 85,000 square feet of work space. Accordingly, 220,000 separate components and fasteners would have to be assembled in order to install an access floor into such a work space. The components and fasteners include: 22,837 pedestal bases; 22,837 pedestal heads; 42,500 stringers; 21,250 panels; 850 panel mounted air diffusers; 68,510 screws; and 22,837 adhesive applications, or ramset shot fasteners.

Logically, the number of separate parts is directly proportional to the number of tasks and steps required to assemble all the parts into a whole. Once all parts are delivered to the field, a taxing and numerous sequence of separate and distinct tasks and worker steps must be completed in order to install the access floor. A task is defined as the complete installation or subassembly of a component of the access floor in one building. An individual worker step is defined as the smallest individual action of assembly and/or installation performed by one worker.

The tasks and individual worker steps involved in assembling an access floor in a four-story building containing 85,000 square feet of work space can be summarized as follows:

Task 1.—Placing Pedestal Bases on Subfloor

Each pedestal base center point must be placed on and attached to the subfloor at the intersection of line markers forming a virtually perfect 2 ft×2 ft, 90 degree matrix. A pedestal base is a flat metal horizontal plate with a vertical hollow metal column. The work crew must accurately locate and snap approximately 320 chalk lines, exactly two feet apart, perfectly perpendicular to 320 chalk lines, exactly two feet apart, on the subfloor of a typical four story building containing 85,000 square feet of the access floor. This task requires two workers snapping 640 chalk lines, which is equivalent to 1,280 individual worker steps as a part of the installation of 85,000 square feet of access flooring in a typical four story building.

Task 2.—Attaching Pedestal Base to Subfloor and Inserting Pedestal Head

A pedestal base (approximately 22,837 in total) must be accurately attached by adhesive or bolt to the subfloor such that the center point of each pedestal base matches up with the intersection of each chalk line. A pedestal head (approximately 22,837 in total) which is a flat plate and perpendicular adjustable threaded shaft and nut, is then inserted into the vertical column of the pedestal base. This task requires one worker to perform two steps per pedestal or 45,674 individual worker steps as a part of the installation of 85,000 square feet of access floor in a typical four-story building.

Task 3.—Leveling Pedestal Assembly to Uniform Elevation

Each pedestal head height is adjusted by rotating the nut on the shaft. The method currently used to adjust the pedestal height employs two workers, a rotating laser beam emitter, a vertical measuring rod and a five foot long 2 inch by 4 inch aluminum channel section. The pedestal leveling action takes place as follows: Worker A kneels on the subfloor and places the aluminum channel such that it bridges three pedestal heads. Worker B places the bottom of the vertical measuring rod on the top of the channel directly above the center point of the pedestal head. Worker A rotates the leveling nut on the threaded pedestal head shaft until Worker B visually sights the matching of a preset mark on the vertical measuring rod with the laser beam line appearing on the rod and tells Worker A that the elevation has been reached. Worker A stops turning the leveling nut and the procedure is repeated at the other end pedestal of the three bridged pedestal set. The center pedestal is leveled without the aid of the laser beam by adjusting the center pedestal head until it reaches the bottom of the aluminum channel. There are approximately 15,224 individual leveling steps performed by a two worker crew plus 7,612 individual leveling steps performed by one worker or a total of 38,061 individual worker steps as a part of the installation of 85,000 square feet of access floor in a typical four story building.

Task 4.—Attachment of Horizontal Stringers to Pedestal Heads

Generally three pedestal heads are bridged by one four foot length of stringer, approximately 1.3 inches by 0.8 inches in cross-sectional dimension, in a pattern which is commonly referred to as a basket weave pattern. This pattern is a succession of two stringers forming a T when attached to the tops of the pedestal heads. Each and every stringer forms a T with each and every other stringer thereby enhancing the structural integration of pedestals and stringers. Several workers attach all stringers to all pedestals with four screws per stringer. Two screws fasten the center of the stringer to the center pedestal and one screw each fastens each end of each stringer to each end pedestal head. There are 20,800 stringers and 83,200 screws resulting in 104,000 individual worker steps to attach all stringers to all pedestals as a part of the installation of 85,000 square feet of access floor in a typical four story building.

Task 5.—Installing The Finish Floor Panels

Contemporary access floor assemblies commonly utilize panels made of a top surface of flat steel plate spot welded to a bottom surface of a dimpled steel plate. The edges of the welded plates are matched and welded to form a uniform flat edge along all four sides of the 2 ft by 2 ft square panel. The combination of the two plates results in a structural panel. The voids created between the top and bottom plates are commonly filled with a light-weight concrete. The concrete filler significantly increases the structural quality of the panel. The concrete filler also enhances the sound dampening quality of the raised access floor. There are 21,250 panels that must be carried from pallets to each 2 ft by 2 ft position in the pedestal and stringer matrix. The panels are then lowered onto the stringers and held in place by gravity. Each stringer top surface, approximately 0.8 inches wide, is shared equally between two adjacent panel sides, the edges of which run along the longitudinal centerline of the top surface of each stringer. This task requires 21,250 individual worker steps as part of the installation of 85,000 square feet of access floor in a typical four-story building.

Task 6.—Cutting Holes in Panels and Installing Air Diffusers

The plenum created between the access floor and the subfloor serves as a large floor-wide forced air supply duct which replaces standard forced air supply ducts usually constructed in the ceiling of the floor area being heated, ventilated and air conditioned. The floor plenum can be divided by vertical sheet metal baffles (plenum dividers) fastened between the access floor and subfloor to divide the plenum into sub-plenums thereby creating any number of HVAC zones. The forced air is supplied through air diffusers, installed in floor panels, from the floor up instead of from the ceiling down in the standard usual designs. In either case, return air is in the ceiling above the floor. When air is supplied from the access floor plenum, the air rises upward and returns at ceiling level. When air is supplied from the ceiling through supply ducts and ceiling mounted diffusers, the air circulates within a stratum some distance above the floor and the air returns at ceiling level through separately ducted air return ducts and ceiling mounted return grills. When supply air diffusers are installed in the access floor, in the case of the floor plenum being the supply air duct, a large hole, approximately 8 inches in diameter, must be cut in a floor panel approximately every 100 square feet of floor area or every 25th panel. Then the diffuser must be installed in the hole of the panel and attached to the panel. This task involves 850 steps by one worker to mark panels, cut holes, and reposition hole cut panels; plus 850 actions of labor by one worker to install diffusers in the hole cut panels. This entire task then requires a total of 1,700 individual steps as a part of the installation of 85,000 square feet of access floor in a typical four-story building.

In short, the six basic tasks involved in assembling and installing all the components of a contemporary access floor, assuming an 85,000 square foot four-story building, usually require approximately 220,000 separate and individual worker steps.

SUMMARY OF THE INVENTION

It is an object of the invention disclosed herein to provide a raised access floor system comprising a unitized understructure subassembly of independently adjustable pedestals and stringers fabricated and assembled at the factory and delivered at the construction site as two different components, a modular stringer frame and a pedestal assembly. The stringer and pedestal components are then assembled at the construction site forming a Module. The Module is then be mated with a mechanized tool comprising computerized laser guided electromechanical leveling functions for simplified and automatized simultaneous multiple pedestal leveling and installation of the raised access floor.

It is another object of this invention to provide structural finish floor panels that physically hold together and integrate all understructure modules. The panel can be manufactured with or without integrated adjustable air diffusers for supply of air for heating, ventilating and air conditioning from the floor plenum, created between the panels of this invention and the subfloor, to the workspace above the panel.

It is another object of the invention to provide for a single pedestal assembly or multiple pedestal and stringer assembly as a separate component for installing the invention on subfloor areas where irregular floor perimeter widths exist or on entire subfloor areas. The single or multiple pedestal assembly, which constitute an integral part of the invention, can be adjusted individually or as a group to a predetermined height with an automatized single, or multiple, pedestal leveling tool.

The access floor system of this invention can be installed with any logical number of pedestals integrated by several combinations of side and/or diagonal stringer arrangements. The flexibility and versatility of installation combinations results in multiple possible geometrical arrangements. For example, the invention provide for Modules having quadrilateral sides with diagonals, and Modules having triangular, right angle, and quadrilateral sides, with or without diagonal stringers.

It is another object of this invention to provide a method to install a unitized prefabricated access floor assembly using an automatized pedestal leveling tool comprising a rotating driving female socket placed to match with the placement of the pedestals in the Module. The leveling tool of this invention can level multiple pedestals using variable speed and reversible rotating means actuated and controlled by separate laser sensors receiving impulses from a rotating laser-leveling beam emitted from an exterior source.

It is an object of this invention to limit the number of laser receivers on the automatized tool to the minimum number of receivers necessary to establish a leveling plane. The minimum number of laser receivers to establish a plane is three (3) forming a triangular shaped plane. Therefore, three or more motor and drive socket units can respond, through a microprocessor, to the level and elevation of the triangular plane established on the automatized tool instead of responding to individual laser receivers separately and independently associated with each motor and drive unit which is yet another object of this invention.

It is yet another object of the invention to provide power, voice and data transmission conduit trays that hang above the subfloor from perpendicular and diagonal horizontal structural members of the unitized understructure.

The invention disclosed herein integrates the following sub-systems: a modular structural component with a tool for automated installation; and two parts to facilitate cabling and HVAC, resulting in a raised access floor system that minimizes labor and installation time. The invention also minimizes the impact of the access floor installation on building construction sequencing and scheduling.

The invention's structural and process improvements over the existing access floor systems primarily result in substantial reduction in the number of parts fastened and assembled in the field, and significant reduction in the size of work crews and person hours involved in installation. Where, for example, 85,000 square feet of existing commonly used access floor system utilizing a 2 ft. by 2 ft. understructure matrix, requires approximately 220,000 individual worker installation steps of fastening and assembly of a like number of separate parts, the invention disclosed herein utilizing a 4 ft. by 4 ft. understructure matrix, requires only approximately 65,000 individual steps. The invention disclosed herein can comprise virtually any logical size and shape understructure matrix other than 4 ft. by 4 ft. square sections, e.g., matrixes comprising a 3 ft., 6 inch square matrix, a 2 ft. by 8 ft. unitized rectangular matrix with a four part 2 ft. square sub matrix are just two examples of sizes and shapes of matrixes possible within the invention disclosed. Each variation of understructure matrix involves a significant reduction in the required number of individual steps.

The assembly disclosed in this application comprises four different basic elements. The first element is the understructure modular stringer frame and pedestal arrangement ("Module"), which are delivered to the building site as two separate fully assembled components. The top portion of the Module is a fabrication of structural metal alloy elements forming a quadrilateral, triangular, or any logical shape frame with or without intersecting diagonals, referred to as the modular stringer frame. The structural metal alloy elements of the modular stringer frame are either cast, fastened or welded in the factory as one piece.

In one of the embodiments of the invention, at the corners and/or at the center of the stringer frame, where the diagonals would intersect, there is a vertical pedestal assembly attached to the stringer frame at the construction site or in the alternative, hinged to the stringer frame in a manner that allows the pedestal to swing into or retract in the horizontal plane of the stringer frame. A locking mechanism locks the pedestal in place. The alternative hinged pedestal is locked in the retracted position at the factory for Module stacking thus facilitating packaging and shipping. When unpackaged and positioned on the subfloor in the field, the pedestals are rotated ninety degrees with the plane of the stringer frame and locked in a perpendicular position with respect to the stringer frame. The five pedestals of each Module each comprise three pieces: an upper housing with threaded female shaft, a threaded male column and a foot.

In another embodiment of the invention, the vertical pedestal assembly is delivered separate from the stringer frame. In this mode, the pedestal assembly is attached to the modular stringer frame at the site of construction. The upper housing of the pedestal assembly is screw locked into a threaded hole at the corners (and at the centers when diagonal stringers are used) of each modular stringer frame. The threaded male column of the pedestal assembly is essentially a long bolt with a driver stud machined at the top end and the other end rounded to facilitate low friction rotation between the tip of the rounded end and its contact with the inner surface of the foot on which the bolt sits. The column is screwed all the way up into the upper housing at the factory such that when the upper housing is screw locked into the stringer frame, the end of the driver stud of the column is flush with the top plane of the modular stringer frame. The foot is fitted at the factory over the rounded bottom end of the bolt type column and is attached to the column once the pedestal is assembled. A telescoping leg comprising a hollow square or round metal tube(leg) welded to a square round metal plate (foot) can replace the foot which is a simple stamped metal shape. The leg would be spring clipped or crimped to the ball shaped end of the column. A portion of the length of the upper housing protrudes below the bottom plane of the modular stringer frame. This protruding portion of the upper housing is a square tube of a size that fits into the leg of the pedestal, or the protruding portion of the housing is of round stock where only a foot is needed. When the threaded column rotates within the upper housing, leg or foot, the pedestal length changes along its vertical axis. Three degree freedom allowed by predetermined tolerances between the lower two components of the pedestal assembly allow vertical adjustment of the Module to a level plane at a uniform elevation regardless of subfloor irregularities common in the building industry. Mating of Modules with the automatized tool for vertical adjustment is facilitated by the interface between adjacent sides of Modules and the operation of the automatized tool.

The outer vertical flat surfaces of the modular stringer frame mate with those of all adjacent Modules to serve as a vertical sliding and guiding surface between Modules during leveling and as an interlocking bearing and alignment surface between leveled and elevated Modules which, when fully installed, form the entire access floor understructure.

Once each Module is placed in its proper location on the subfloor, the vertical adjustment of all pedestals of each Module is made simultaneously and automatically by a system comprising a computerized laser guided electro mechanical leveler ("CLGEL") which is mechanically mated with each Module. The mechanical mating is made possible by a male stud machine cut into the top of each threaded male column of the pedestals. Matching female sockets at the bottom of the CLGEL can then be inserted into the Module and fitted onto the matching studs of the threaded male columns.

The CLGEL is housed in a metal stringer frame of the same horizontal geometry as the Module. Mounted on the CLGEL frame or housing are the electronics, optics, and electro mechanical devices that in combination adjust the elevation of the Modules. The CLGEL housing frame is greater in height than the stringer frame for greater strength as a tool component. The matching horizontal geometry facilitates visual alignment of the CLGEL with the Module during operation of the CLGEL. Starting from the bottom up, the CLGEL has vertical female sockets located in such an arrangement that each of their vertical axes aligns with the vertical axis of each corresponding male stud of each pedestal of the Module. The socket is the sliding pin type B a commercially available tool to allow easy insertion and release during operation. Each socket is attached to a variable speed, bi-directional (forward and reverse) electric motor that rotates each socket and stud. The socket fits on a sliding spring-loaded tool that forces the socket to maintain positive engagement with each bit while traveling vertically during leveling to a pre-determined Module elevation. Connected precisely above each axis of each socket tool is a vertical laser light sensor at the top of the CLGEL. A computer micro-processing unit is mounted on the CLGEL frame.

The CLGEL is designed to be hand-carried and positioned from Module to Module. There are handles for workers to move the CLGEL. There are fluorescent lights mounted on the frame of the CLGEL to enhance worker sighting and accurate manipulation of the CLGEL on each Module. A control box is mounted on the frame of the CLGEL for programming and operation.

The power supply to the CLGEL can be from rechargeable batteries mounted on the tool frame or, from house power line supplies. A standard tripod mounted rotating laser beam transmitter, placed on the subfloor, sends a level laser beam set incrementally above the desired finish access floor elevation to the CLGEL laser sensors (receivers), the increment allowing for the distance between the finish floor elevation and the center point of the height of the laser sensor. The laser sensors mounted on the CLGEL signal its computerized processor, which independently actuates and controls each of the electric motors to rotate each of their sockets mated to their corresponding studs of each of the multiple pedestals of each Module. The studs rotate in forward and/or reverse directions independently until the threaded male column in each pedestal screw elevates or lowers each upper housing of all pedestals until the top plane of the stringer frame of the Module reaches the uniform elevation read by the laser sensors. The laser sensors, sensing the incoming laser beam, are read and translated through the computerized microprocessor to actuate the electro mechanical motors, drive sockets and studs forward, reverse and stop until exact finish floor elevation is reached.

The installation method of this invention involves the following steps:

1. Snap two corner chalk lines at the sub floor layout starting corner of each major area to be fitted with access floor. This should require approximately eight chalk lines per building floor.

2. Setup standard tripod mounted rotating laser beam emitter on of building subfloor. Set laser beam elevation.
3. Build a Module by screw locking pedestals into each of the corners and diagonal center(where applicable) of a modular stringer frame.
4. Invert and carry a Module to a building layout starting corner and place the Module on the subfloor with two of its corner sides precisely aligned with the perpendicular corner chalk lines.
5. Position the CLGEL on the Module lowering and guiding the CLGEL until its sockets fully mate with the pedestal studs of the Module. Press the elevation command button on the control box, which actuates automatic leveling of all pedestals to the preset elevation of the Module. Repeat the above steps until one complete row of Modules is installed in one direction. Complete additional rows until an entire floor is completed less the irregular width perimeters around building cores, interior columns and exterior walls. A perimeter module and perimeter pedestal is used for perimeters and will be described in detail in the following section.
6. Install perimeter modules and pedestals.
7. As each set of four adjacent Modules are fully installed forming a square array, insert and lock the corner locking device described in the following section of detailed descriptions. Place finish floor panels in their proper places on the array of Modules. Finish floor panels made with HVAC diffusers can be randomly placed in the array and relocated later according to occupancy.
8. Cable trays can be hung from stringer frames as occupancy of the floor dictates power, voice and data system requirements.
9. Plenum dividers (sheet-metal baffles) establishing HVAC zones can be inserted under and along any modular stringer frame member between the member and the subfloor.

In an alternative embodiment of the present invention, the freestanding pedestals in single or multiple pedestal arrays are installed with the automatized tool having a corresponding number of single or multiple drive sockets, motors and laser receivers. Instead of the automatized tool being freestanding on freestanding pedestals, an alternative device and corresponding method claimed separately in this application involves an electromagnetic, magnetic, mechanical or electro-mechanical freestanding pedestal holding device flanking or surrounding each automatized tool drive. In this method, the automatized tool is set on the subfloor in a leaning back position exposing the underside of the tool thereby allowing a worker to attach, with the holding device(s), any number of freestanding pedestals to the underside of the tool and simultaneously mate each freestanding pedestal with its corresponding tool drive socket. The worker then applies adhesive to the bottom plate of each telescopic leg or to the foot of each pedestal for its affixation to the subfloor. The two workers then lift the tool and its held freestanding pedestal(s) and place them on the subfloor in the correct location. After the automatized tool completes its automatic leveling and elevating process, the two workers cause the electromagnetic, magnetic, mechanical or electromechanical freestanding pedestal holding devices to release their hold and then lift the tool off of the correctly placed, leveled and elevated freestanding pedestal(s), and return the tool to a worker for attachment of the next sequence of freestanding pedestals to the underside of the tool. While new pedestals are being attached to the tool, the two workers place a template on the previously installed array of freestanding pedestals. The template is a three dimensional rigid frame of the identical horizontal geometry and array of electromagnetic, magnetic, mechanical or electromechanical freestanding pedestal holding devices as the automatized tool. When the template is placed on the installed array of freestanding pedestals, the template's holding devices are activated thereby causing a firm and stable assembly of template and freestanding pedestals adhered to the subfloor. The assembly of template and pedestals act as a physical datum for guiding the precise placement of a successive array(s) of freestanding pedestals. A section of the template cantilevers over the subfloor beyond the boundaries of the previously installed pedestal array in a way that provides a guiding edge for precise positioning and alignment of the subsequent array of freestanding pedestals attached to the tool and ready for installation. This process is repeated until the entire matrix of freestanding pedestals is installed.

The steps of the method enumerated above and the summary of this invention so far describe how the access floor of this invention can be installed in an automatized manner and using Modules. The net gain in the field provided by this invention, in the mode(4 ft.×4 ft. with diagonals) exemplified herein, when compared to the systems being utilized in today's market is the elimination of approximately 155,000 individual field worker steps. As set forth above, the common access floor systems used today and disclosed by the prior art require approximately 220,000 individual field worker steps, while the invention disclosed herein would require approximately 65,000 individual field worker steps to install 85,000 square feet of access floor in a four story building.

The rigid square Modules of the invention, when set in place on the subfloor, are self-aligning to form their own matrix or grid array on the subfloor. This feature eliminates the need to snap the many matrix chalk lines required by the prior art. The integrated pedestals of the Modules allow placement of the pedestal feet precisely where they are supposed to be on the subfloor directly under the matrix formed by the adjacent rigid stringer frames above. The prior art requires location, leveling, fastening, placement, and assembling of individual pedestal and stringer components in the field. The large number of steps, therefore, require tedious and time consuming labor in order to obtain true and accurate installation.

The invention disclosed herein comprises a Module designed to be manufactured in a state of the art mass production factory with high productivity and quality control. This invention replaces low efficiency labor intense practices in the field associated with the prior art, with high efficiency human capital and automated machinery of the factory production line, which manufactures the invention. Time to produce the Module is consumed in the factory rather than in the building site while the systems disclosed in the prior art require much longer installation time. Relatively small amounts of human capital and automatized tools required to install the invention in the field replace large amounts of labor using rudimentary tools and procedures to install the prior art.

Lateral (horizontal) stability of the prior art relies on relatively small diameter fastening screws attaching individual stringers to individual pedestals. Prior art panels fit into the matrix of stringers without forming a structural union between panels and stringers unless the panels are screw fastened to the stringers which diminishes the accessibility of access flooring—maximum access being its primary function. By contrast, the panels of this invention have a slot formed in their undersides along one diagonal of each square panel, which straddles two adjacent sides of every adjacent two Modules. Panels can be made with underside channels along both diagonals for straddling an additional stringer designed to be attached to and span two center pedestals of two adjacent Modules in specialized cases where greater panel and stringer frame load characteristics are required.

Each Module of the invention is a unitized structural steel frame interlocked at every intersection of four adjacent Modules by a bolted steel plate corner lock further strengthened by adjacent sides of all Modules being interlocked by a panel with its underside channel straddling each pair of adjacent Module sides. In certain seismic zones, shear bracing between some elements of the understructure and welded attachment of pedestals to certain embedded structural steel in the subfloor is required. A collar or yoke, and cross bracing assembly can be bolted to every two pedestal groups thereby uniting each group of four pedestal feet and bracing them together along a designated structural shear line. Therefore, the invention makes for a more structurally integrated and a more rigid access floor system.

Panels can be manufactured to have integrated HVAC diffusers in a variety of shapes and functions to satisfy many types of building occupancy. A few examples are presented: Dense human occupancy where many workers sit in small cubicles requires a relatively small isolated adjustable diffuser at each workstation. Building perimeters require linearly placed slot diffusers which are long rectangular shaped slots running parallel with and close to the building perimeter where temperature gradients are most extreme near windows. Computer rooms, break areas and conference rooms have entirely different HVAC requirements necessitating different arrays and combinations of diffusers. Standardization of diffuser shapes and sizes in the invention panel such that varying quantities of diffusers for any given occupancy use can be a function of the number of HVAC diffuser equipped panels installed in a type of occupancy.

The manufacture of the invention HVAC diffuser equipped panel in a highly productive factory replaces the more labor intense practice of manually cutting round holes through the prior art panels, generally the commonly used concrete filled steel plate panels, and inserting an expensive diffuser as a field retrofit. The invention HVAC diffuser equipped panel is adjustable and can be locked from the human standing position and can be removed in part or in whole thereby giving easy access to the myriad electrical and electronic cabling and connections in the plenum below. The prior art commonly utilizes a slotted or perforated basket and round grill and lid made of polymer or plastic like material, and in some models B steel, set in the hole cut in the prior art panel in the field of installation. The same panel hole is sometimes cut in the factory, however, the diffuser is generally always installed into the panel in the field. The prior art diffuser is generally adjustable from the human kneeling position and generally cannot be effectively locked, but is removable in part or in whole allowing easy access to the plenum below and allowing inaccurate adjusting by virtually anyone thereby causing disequilibrium in the HVAC function.

The CLGEL is designed to elevate the Module from the factory preset lengths of the pedestals. All pedestals of each Module are set to their lowest elevation at the factory. The full range of elevation is plus or minus a certain distance from the specified elevation, approximately midrange, required by the design plenum height. Pedestals can be manufactured to different plenum height designs and different ranges of vertical adjustment. When the Module is first set on the subfloor it is at its lowest elevation range. When elevated to the design height of the plenum, the Module should be near the pedestal's midrange. As stated above, the CLGEL simultaneously adjusts the height of all pedestals of each Module. The CLGEL then tests the contact of each pedestal foot with the subfloor by separately elevating each pedestal of the leveled Module until the laser sensors sense the pedestal to be fractionally higher than correct elevation, and then the motor drive of that pedestal lowers it to correct elevation. The final adjustment of each pedestal, for the purpose of assuring that each pedestal foot is in contact with the subfloor, can be achieved by integrating and compounding laser sensors and torque sensors with CLGEL drive motors. The torque sensors and the laser sensors simultaneously read by the control box electronics to stop each drive motor when correct elevation and full subfloor contact occur.

The invention includes a single or any logical multiple pedestal automatized leveling tool which mates with a single or any logical multiple of freestanding vertically adjustable pedestal(s). This part of the invention is referred to as the Free Standing Single/Multiple pedestal CLGEL ("FSSMPCLGEL"). The FSSMPCLGEL comprises the same computerized laser guided technology as the CLGEL except that the FSSMPCLGEL further comprises one, or multiples of: driver stud, electric motor, torque sensor and laser sensor. The FSSMPCLGEL is equipped with electromagnetic, magnetic, mechanical or electromechanical freestanding pedestal holding device(s) that fit(s) over the single or multiple pedestal arrangement much like the CLGEL acts. The holding devices allow the combination of freestanding pedestals and FSSMPCLGEL to free-stand vertically on the subfloor. A single pedestal head functions essentially the same as the invention pedestal assembly except that a flat plate with a hole is rigidly attached to the top of the pedestal assembly—the plate hole allowing the FSSMPCLGEL to mate with the drive stud of the pedestal assembly. Screw holes or other fastening features are made into the plate to receive the connection of virtually any industry standard panels and/or stringers. The foot or leg base plate of the freestanding pedestal assembly disclosed in the invention is larger in area to allow adhesive to be applied between the base and the subfloor. Otherwise, the single or multiple freestanding pedestal arrangement acts in the same manner as the standard pedestal assembly in the elevating and leveling mode function of the Module After the freestanding pedestal(s) array is: precisely placed on and affixed to the subfloor; and elevated and leveled by the FSSMPCLGEL, current to the electromagnetic holding plates is switched off and the FSSMPCLGEL is removed from the array of freestanding pedestals and then the same current is switched back on and additional freestanding pedestals are replaced on and electromagnetically held by the FSSMPCLGEL for application of adhesive to a new set of freestanding pedestal. This process is repeated until all freestanding pedestal arrays are affixed to the subfloor. Each prior array of freestanding pedestals affixed to the subfloor serves as a datum position for each successive array to be affixed to the subfloor. A movable three dimensional rigid alignment template, with an array of electromagnetic holding plates that coincide with the head plates of each array of freestanding pedestals affixed to the subfloor (prior array), is placed on the prior array and the template's electromagnets are activated thereby causing a firm stable assembly of template and prior array as a physical datum for guiding the precise placement of a successive array(s) of freestanding pedestals electromagnetically held to the FSSMPCLGEL. The movable template and the FSSMPCLGEL can be fitted with mechanical holding plates in lieu of electromagnetic holding plates that mate with the tops of the free standing pedestals to hold the pedestals firmly to the FSSMPCLGEL during installation, leveling and elevating; and to mechanically hold the installed pedestals firmly to the template for stable alignment of successive arrays of freestanding pedestals following each installation by the FSSMPCLGEL of an array of pedestals. If stringers are not required in this freestanding pedestal mode, panels can be directly screw fastened to the pedestal head plate which has holes ready (pre-drilled or threaded) to receive standard screws. The rigid template with its electromagnetic holding plates can be used to hold an array of prior art pedestals while: adhesive is applied to prior art pedestal bases; pedestal arrays are located and precisely placed on the subfloor; and the array of prior art pedestals are manually leveled and elevated. In this mode, two or more rigid templates can be used in tandem to install successive arrays of freestanding prior art pedestals. Electromagnetic holding plates, of the rigid template, can be substituted with mechanical holding plates thereby removing the need for electrification of the rigid template.

Figure 1:
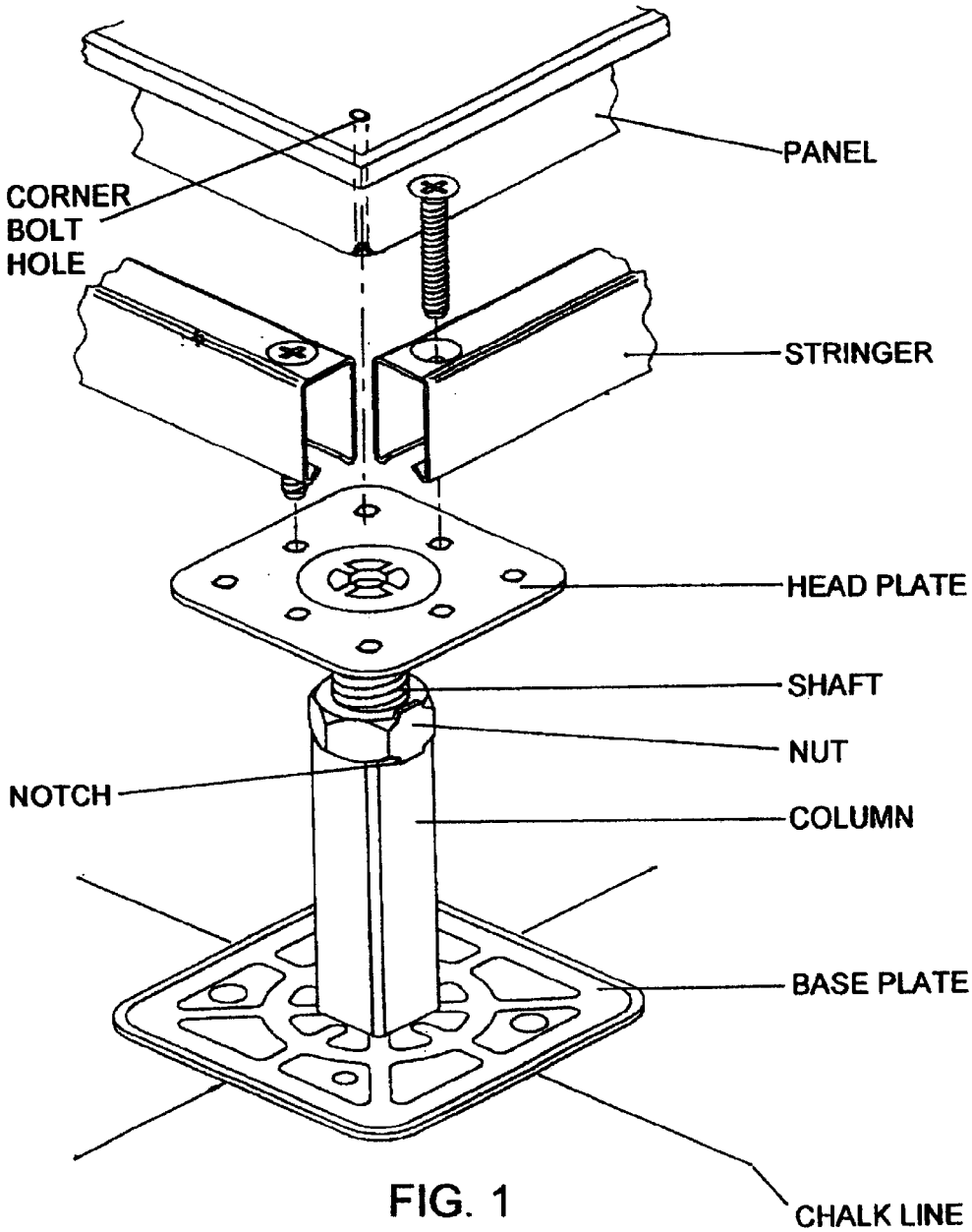
FIG. 1 PRIOR ART
FIG. 1 is a perspective view of the most common prior art. From bottom up, the drawing shows an intersection of chalk lines on the subfloor. The next component is the pedestal base assembly made of a flat square base plate welded to a vertical hollow square tube column. The base plate is usually fastened to the subfloor with adhesive. Next up a pedestal head assembly made of a flat square head plate welded to a vertical threaded shaft threaded into a nut machined with a catch that fits into a notch in the base column. The nut rotates about the shaft when the nut and shaft are lifted out of the base column notch for vertical adjustment. When fully adjusted, the positioned nut on shaft is lowered into the base column notch. The correctly elevated pedestal head(s) receive the stringers. Stringers are screw fastened to the pedestal head plate. The floor panel is then lowered into the frame formed by the stringers. When stringers are used in this assembly, the corner bolt is optional. When stringers are not used, the corner bolt is required to connect to and stabilize the location and orientation of the pedestal.
Figure 2:
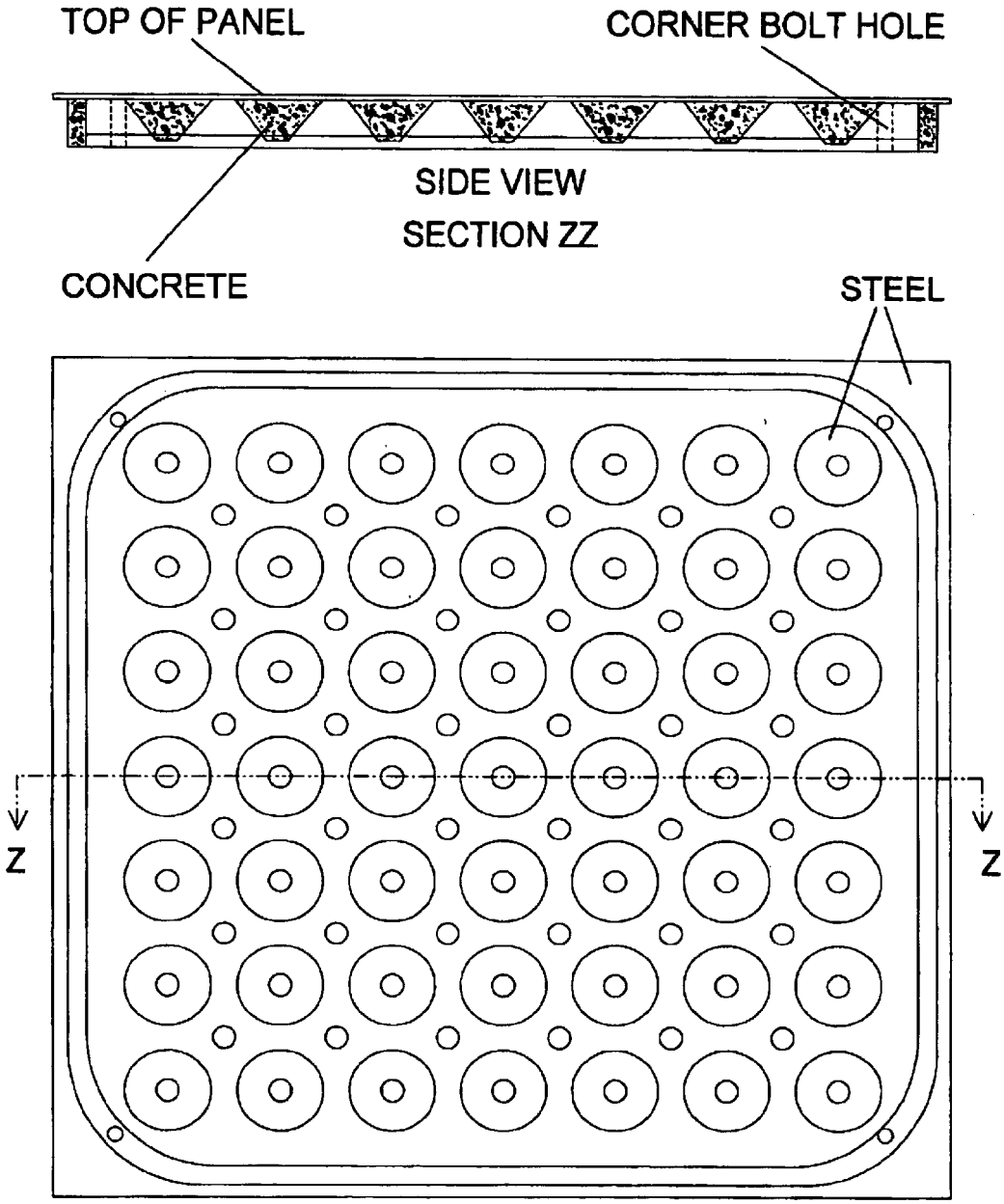
FIG. 2 PRIOR ART
FIG. 2 is an example of a commonly used concrete filled steel panel in the prior art. These panels are generally 2 feet square. One prior art pedestal vertically supports four corners of four separate panels.
Figure 3A:
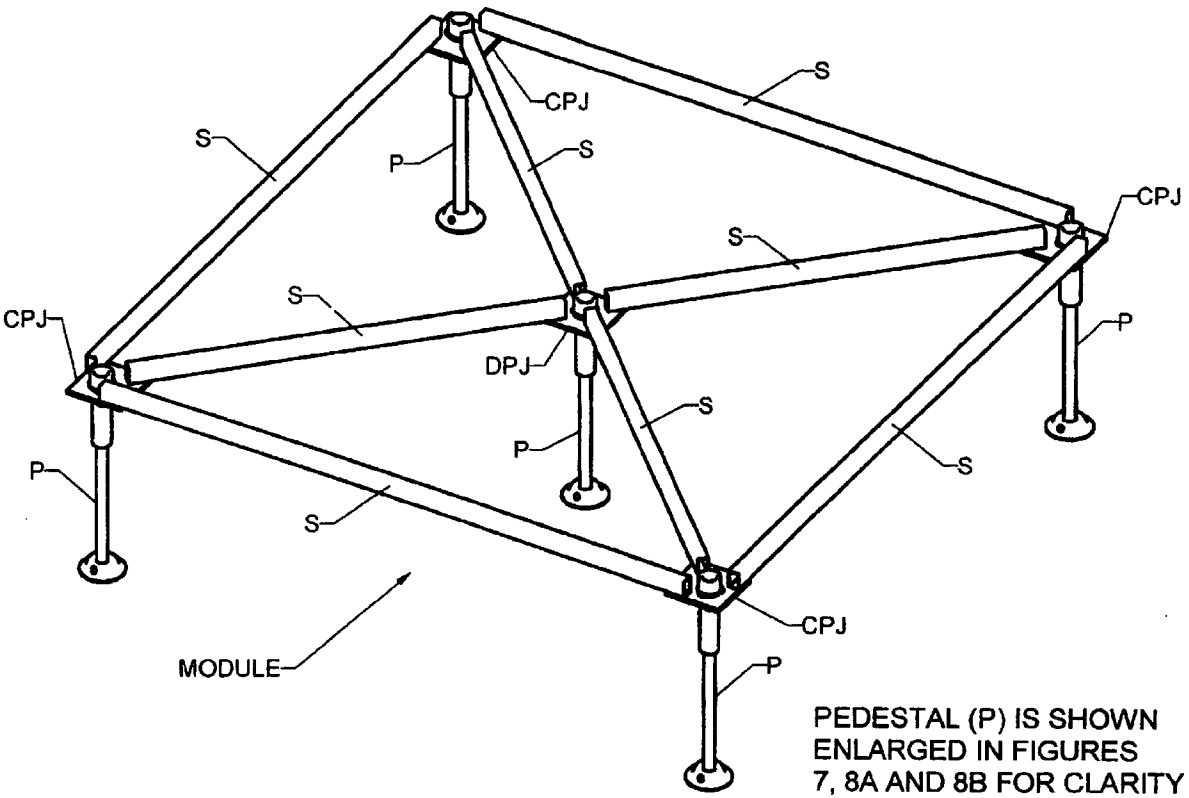
FIGS. 3A and 3B show two perspectives of a Module with five pedestals (P) inserted in place by thread lock into four corner pedestal joints (CPJ) and one diagonal pedestal joint (DPJ). The corner and diagonal pedestal joints connect the eight side and diagonal stringers (S).
Figure 3B:
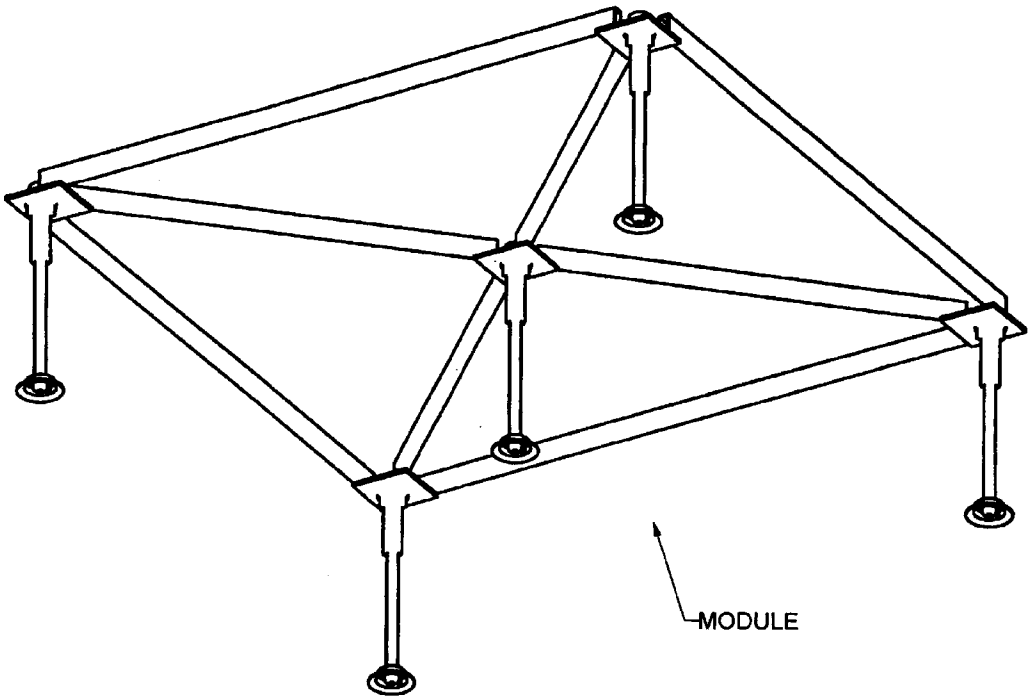
Figure 4:
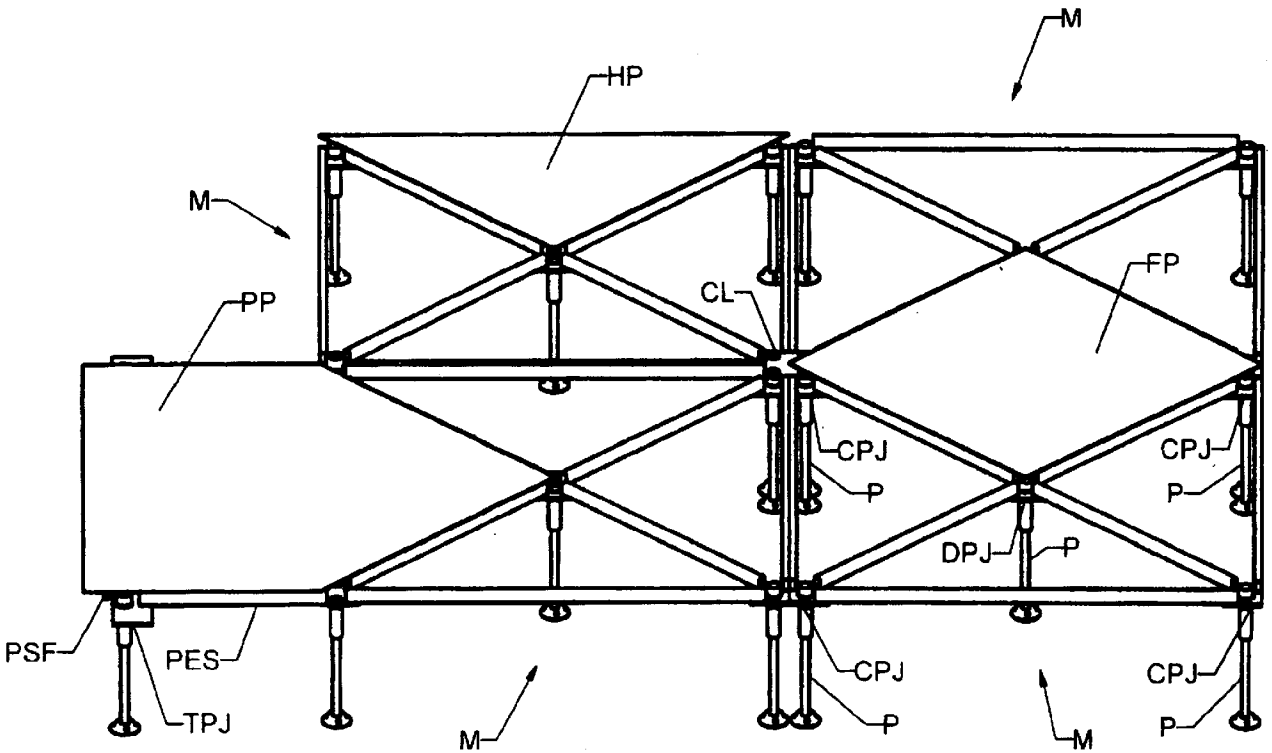
FIG. 4 is an top perspective of an array of four Modules and one Perimeter Stringer Frame (PSF) of the invention showing each Module's (M) horizontal orientation of four sides and two diagonals rigidly formed in the factory. This drawing shows the diagonal pedestal joint (DPJ) at the intersection of two diagonals, and the four corner pedestal joints (CPJ). Each diagonal and corner pedestal joint is threaded to receive the insertion of a pedestal (P) in the field of construction prior to setting a completely assembled Module of one stringer frame and five pedestals on the subfloor. In the center of the four Module array, four corner pedestals of four Modules gang together. All pedestals function exactly the same. After each Module of any four Module array is elevated and leveled, a corner lock (CL) is connected with four bolts or lugs with a threaded section of the top of each pedestal column. A perimeter stringer frame (PSF) is used to form the invention understructure between arrays of Modules and exterior walls, building cores, and columns where horizontal distances vary between Module arrays and building subfloor boundaries. The perimeter stringer frame threaded T-pedestal joints (TPJ) receive pedestals in the same manner as diagonal and corner pedestal joints. The perimeter extension stringer (PES), not shown, can be added to further enhance structural strength, can be of different lengths of constant increments fixing the distance between the Module and the perimeter stringer frame to correspond with one of several channels in the perimeter panel (PP). The perimeter extension stringer fits into and locks two corner pedestal joints together with two bolts threaded into two pedestals while the opposite end of the pedestal extension stringer snap locks onto the T-pedestal joint. Full panels (FP) are placed on Modules such that the diagonal of a full panel coincides with two adjacent sides of two adjacent Modules. A channel is formed in the underside of a full panel to facilitate the fit between full panel and Modules. A half panel (HP) fits in a Module that would be against a wall, building core or column boundary. A half panel can also be used anywhere or everywhere on a Module.
Figure 5:
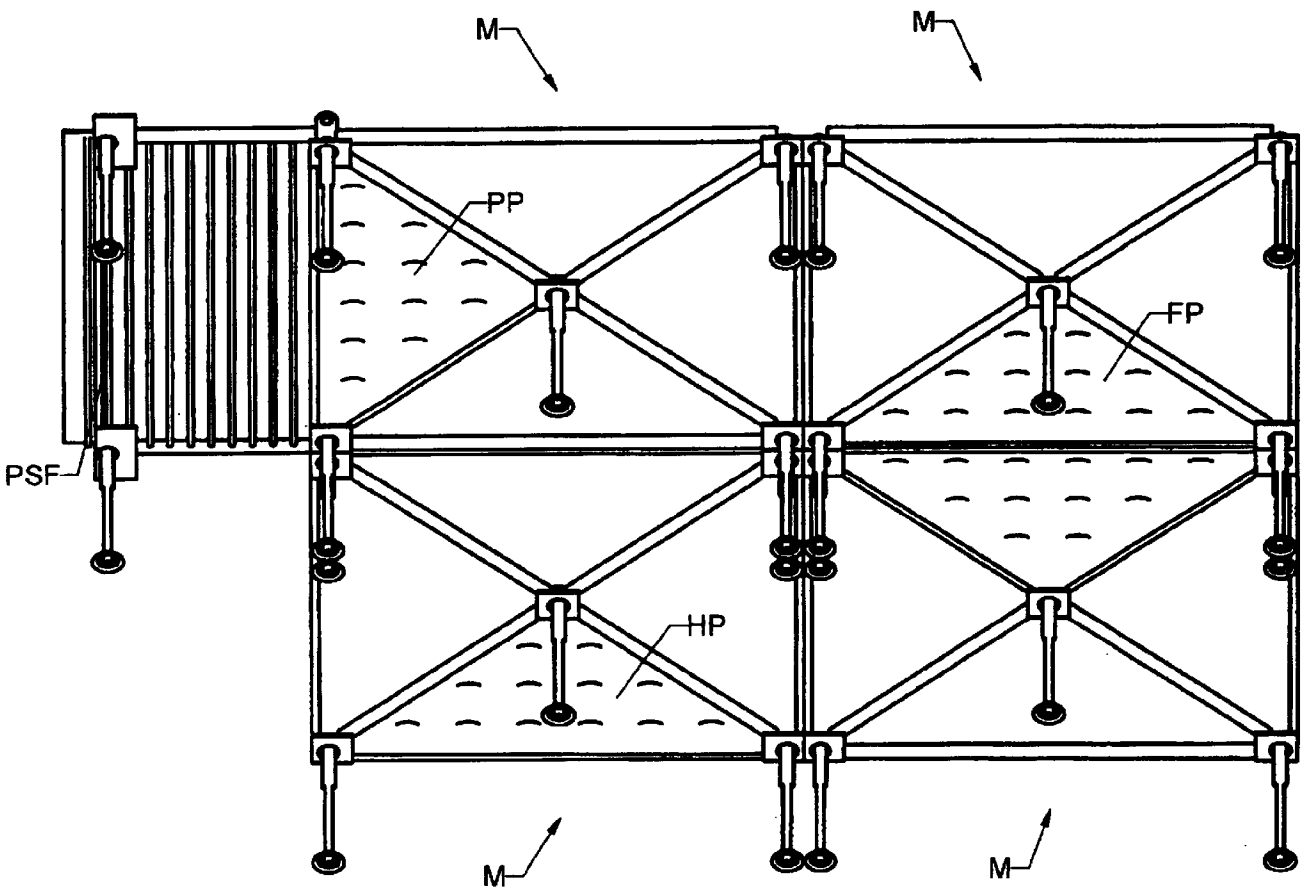
FIG. 5 is a bottom view of the perspective of FIGS. 4&6. This figure demonstrates how the three different panels; full panel (FP), perimeter panel (PP) and half panel (HP) fit into the Modules (M) and Perimeter Stringer Frame (PSF).
Figure 6:
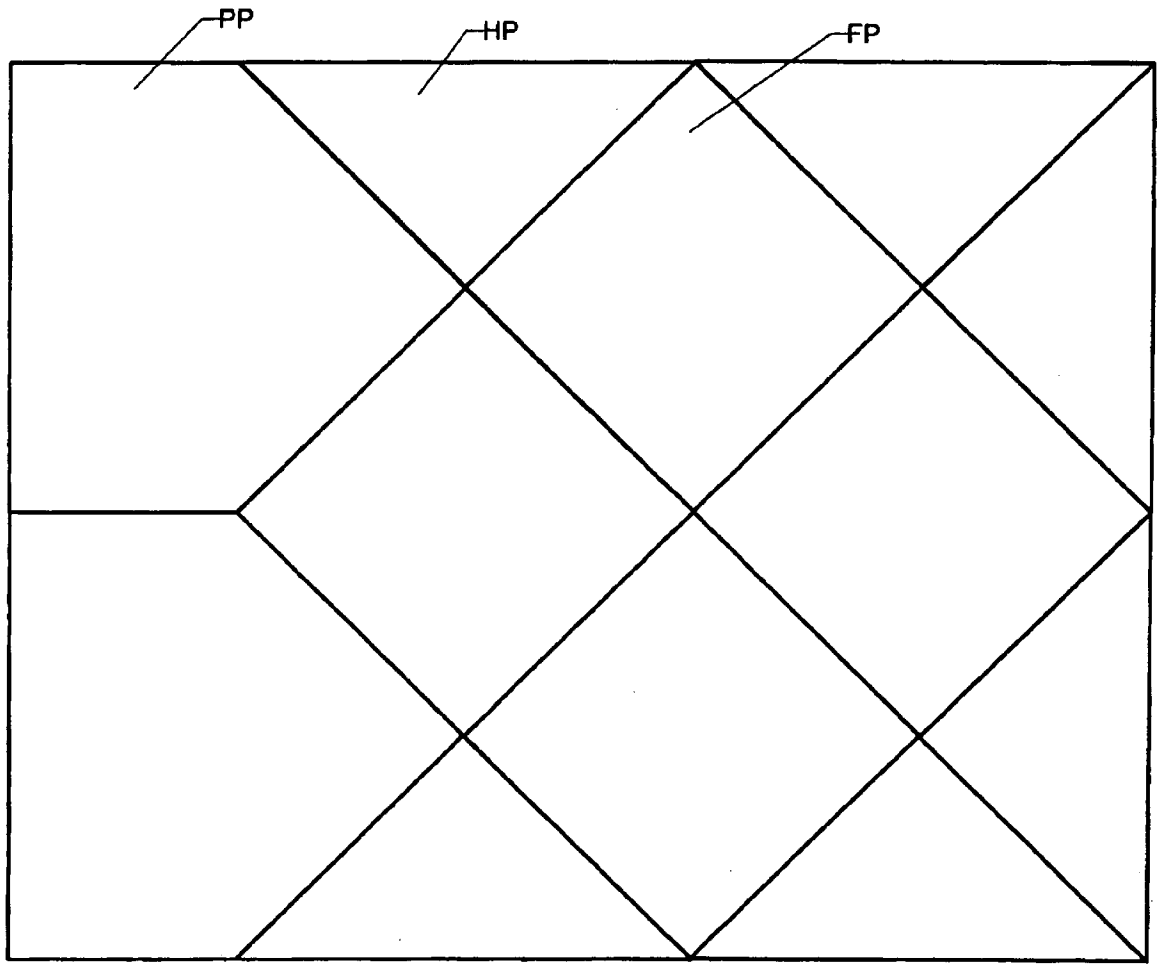
FIG. 6 as a top plan view would have no visible understructure, i.e., Modules including pedestals, and perimeter stringer frames, if all four full panels, six half panels and two perimeter panels were in place.
Figure 7:
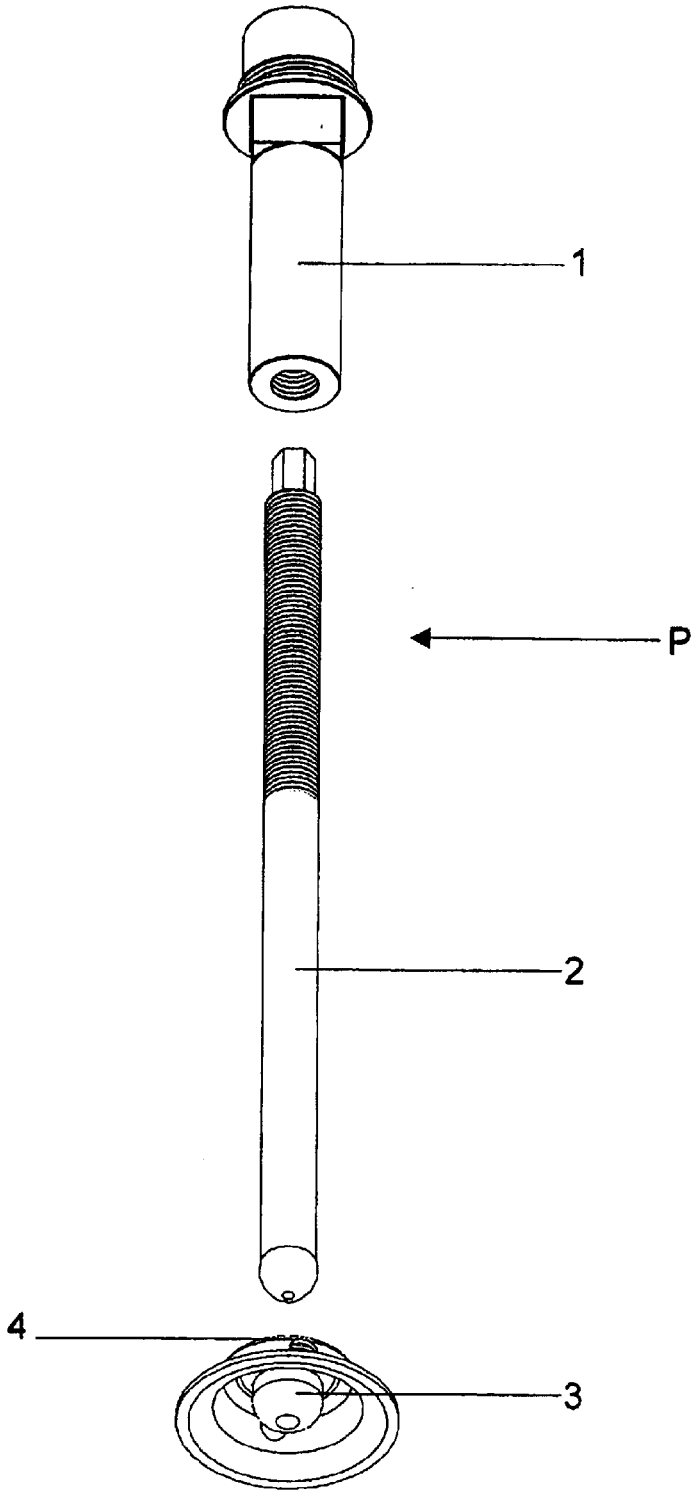
FIG. 7 is a perspective of an exploded pedestal assembly. The pedestal assembly is made of four parts: upper housing (1), threaded male column (2), foot (3) and attaching means (4). The threaded male column is essentially a bolt shaft with a small ball shaped or rounded head and a driving stud machined at the leading end. The threaded male column is turned all the way into the upper housing at the factory to the extent that the top of the stud is flush with the top of the upper housing placing the pedestal assembly in the fully retracted position. The foot is then attached to the ball shaped or rounded head of the threaded male column in a way that holds the foot without inhibiting column rotation. The assembly is in the fully retracted position before leaving the factory for the installation site.
Figure 8A:
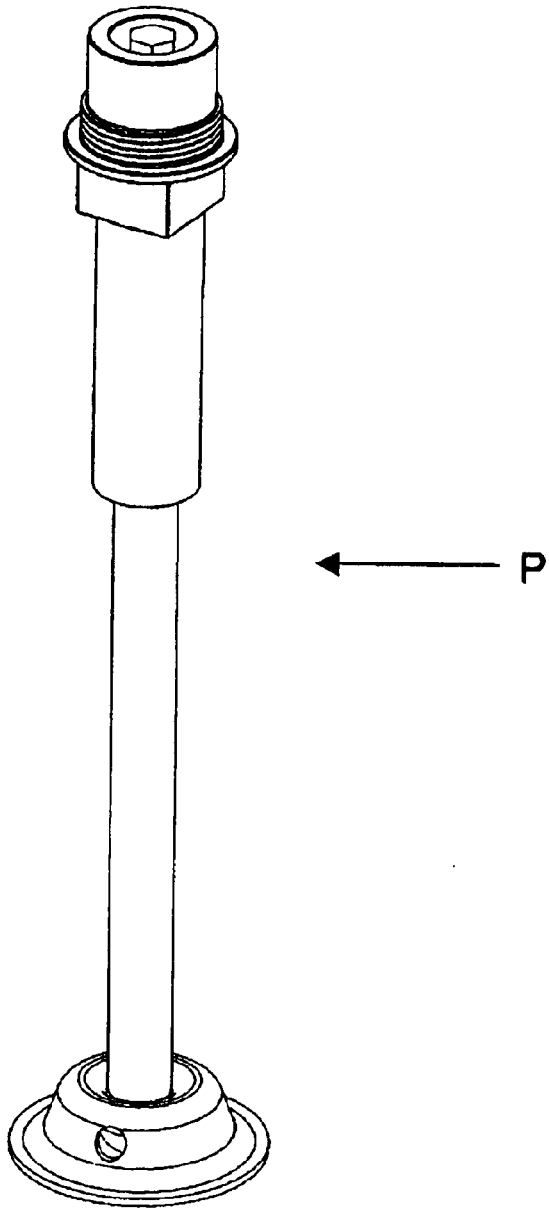
FIG. 8 shows two perspectives of the pedestal fully assembled in two positions: retracted (A) and extended (B). In actuality, the pedestal assembly is not extended until after it is inserted into the corner and diagonal joints of the stringer frame shown in FIGS. 3A and 3B.
Figure 8B:
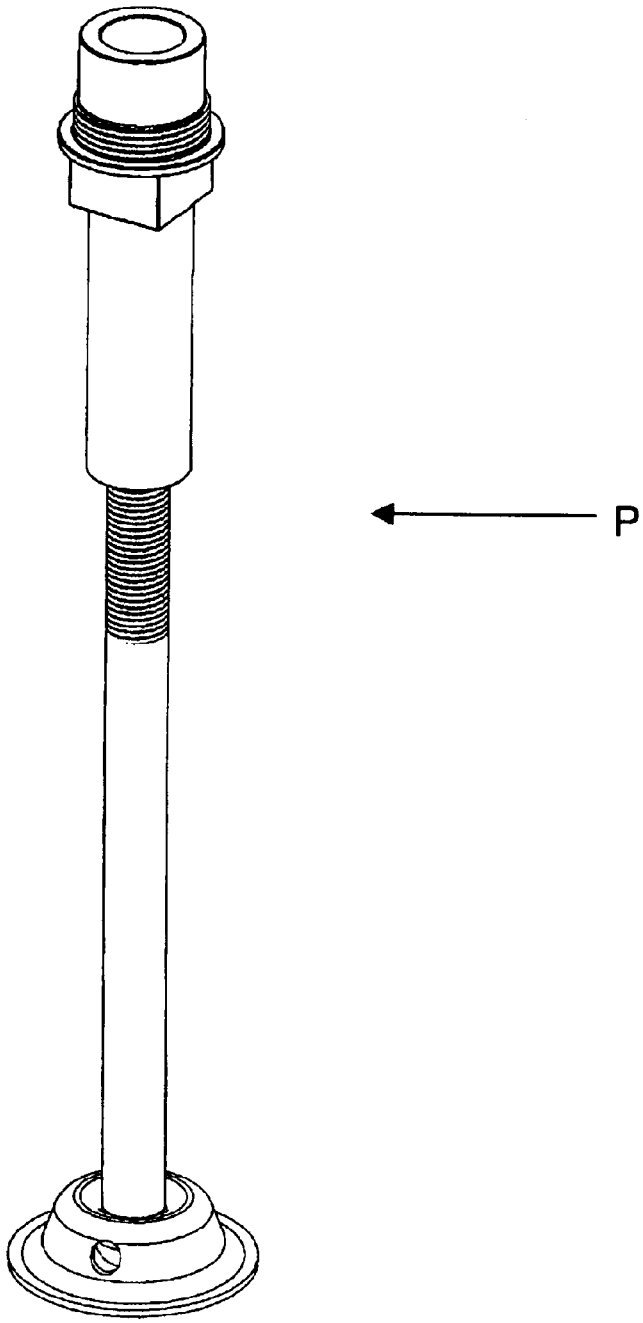
Figure 9:
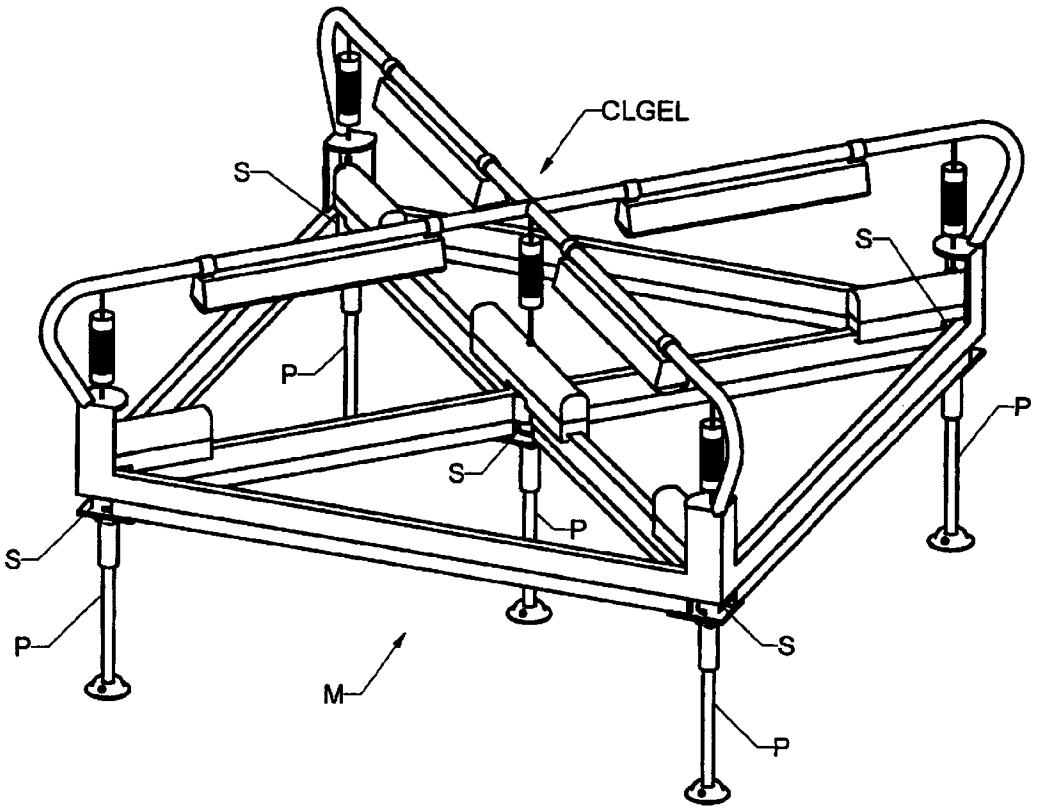
FIG. 9 shows the automatized leveling tool (CLGEL) in the operation position on a Module in the elevating and leveling mode. In this figure, the telescoping leg type pedestal is shown. The horizontal two dimensions of the bottom plane of the tool are exactly the same as the respective dimensions of the upper plane of the Module. The vertical axes of each of the five sockets (S) align with those of the five threaded male columns of the five pedestal assemblies (P) inserted into the Module.
Figure 10A:
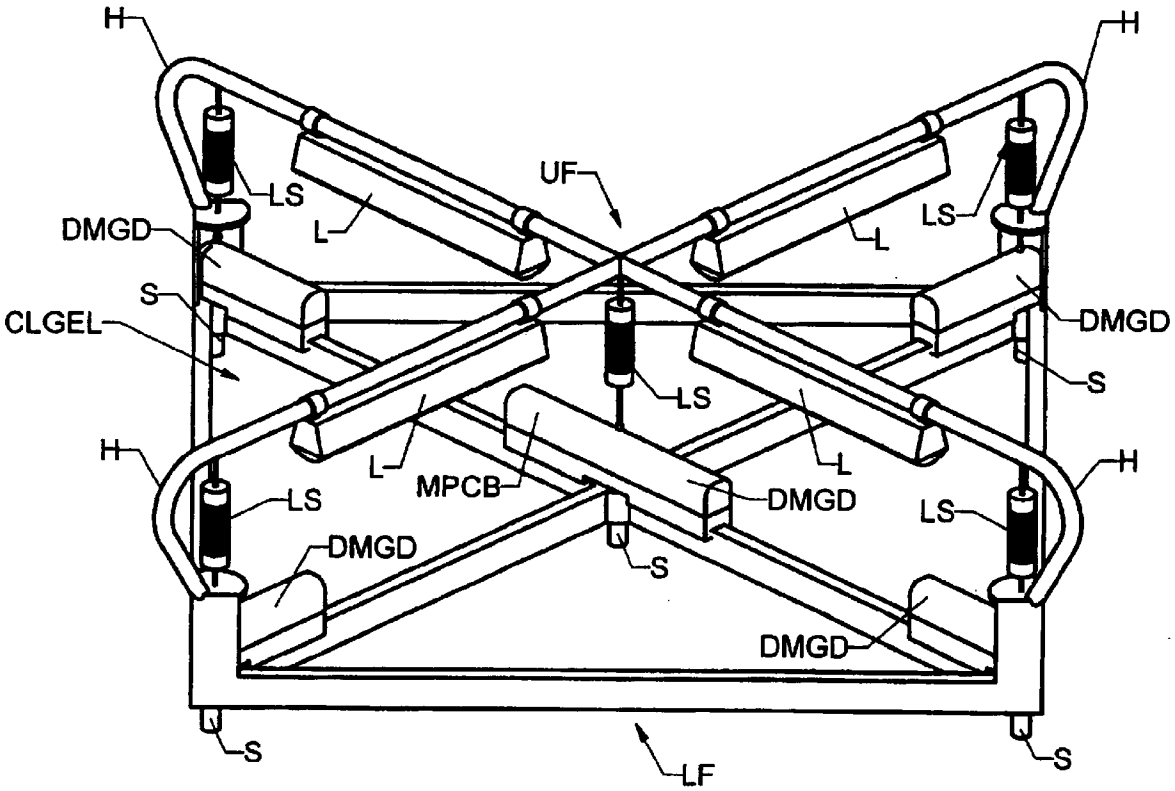
FIGS. 10A and 10B show above and below perspectives, respectively, of the automatized leveling tool, the Tool. The Tool's upper frame (UF) provides: four handles (H), four fluorescent lights (L), and suspension and electrical connection for five laser sensors (LS). Three laser sensors establishing a leveling plane can replace the five sensors shown. The upper frame is hollow metal tubing which serves as conduit for electrical wiring. The Tool's lower frame (LF) provides: five electric drive motors and gear drives (DMGD), a microprocessor and control box (MPCB), and five driver sockets (S). The lower frame is hollow rectangular metal tubing to facilitate electrical wiring.
Figure 10B:
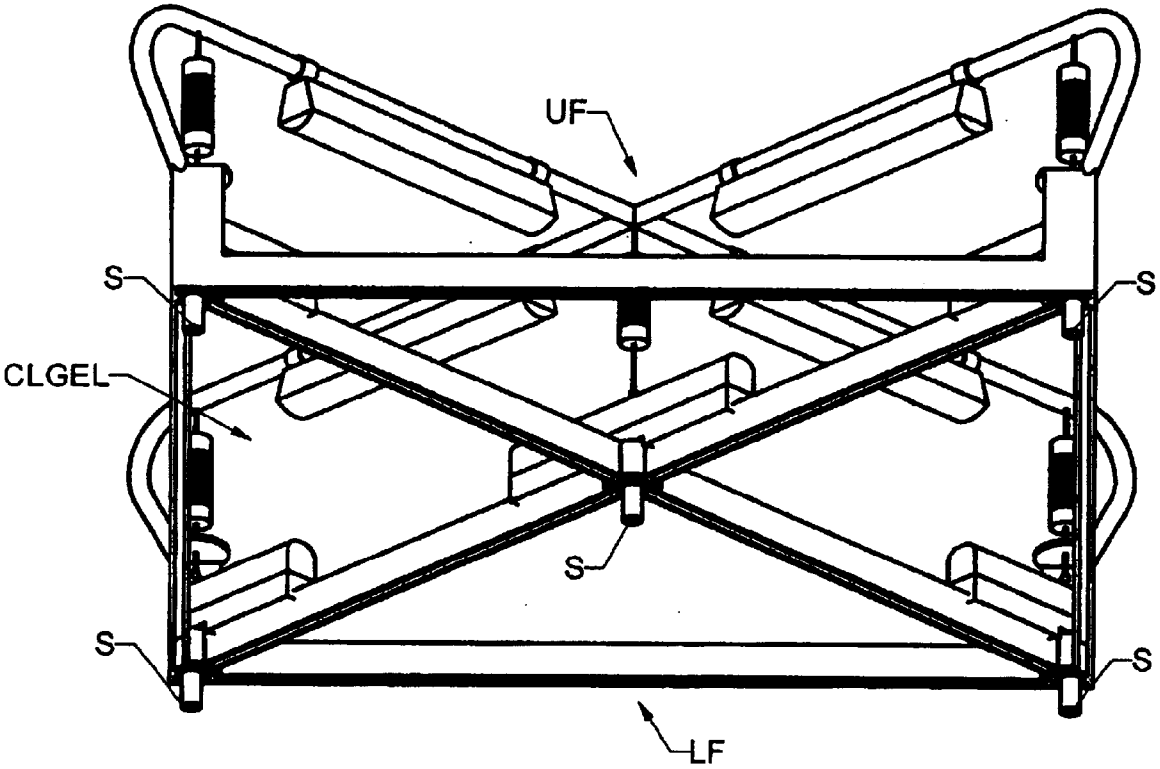
Figure 11:
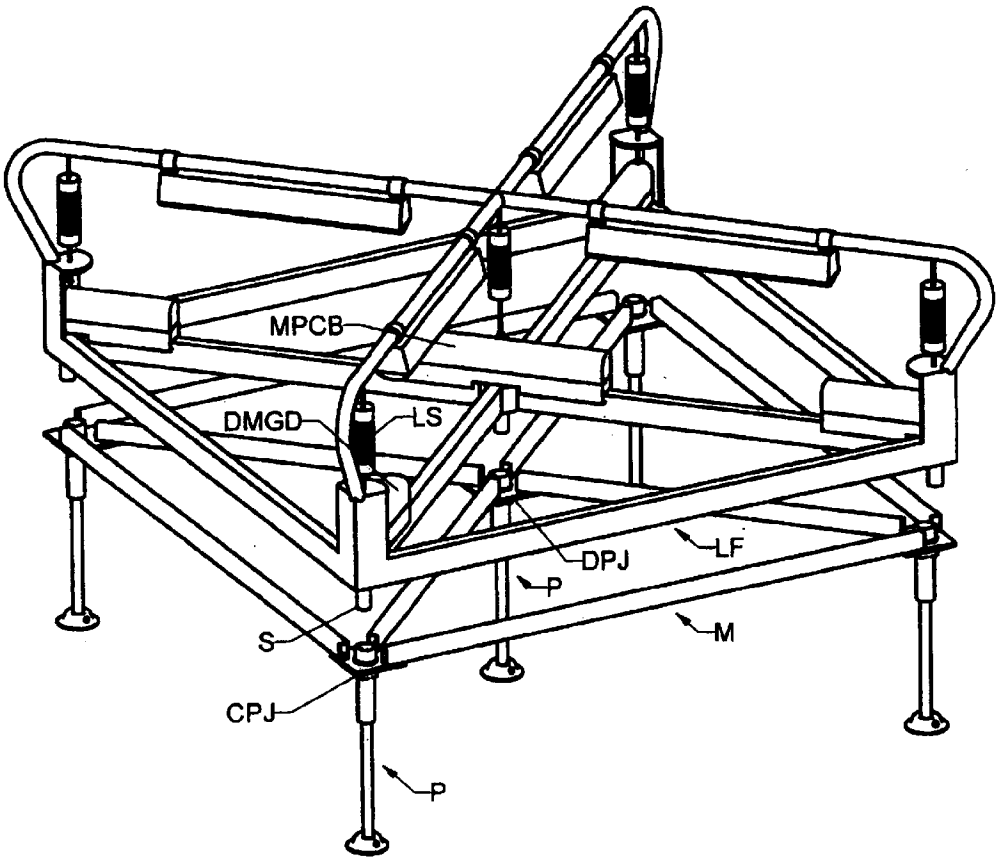
FIG. 11 shows the Tool aligned a few inches above the actual mounted position on the Module. The lower frame (LF) of the tool coincides with the top plane of the Module allowing the five sockets (S) to fit into the five pedestal joints (DPJ, CPJ) of the Module allowing the five sockets to engage the five driver studs of the threaded male column of the five pedestal assemblies. When the lower plane of the Tool is completely lowered onto the Module, the Tool is activated from a hand held remote control. The five laser sensors, or three planar sensors not shown, receive the level laser beam transmitted from a freestanding rotating laser transmitter preset at a predetermined elevation. The microprocessor and control box independently correlate the point at which the laser beam contacts each sensor relative to the correct level elevation point on each sensor and actuates each motor to drive each threaded male column independently until the extension or telescoping of each pedestal elevates and levels the Module to the desired position above the subfloor. This process is repeated until all Modules are installed, elevated and leveled uniformly.
Figure 12:
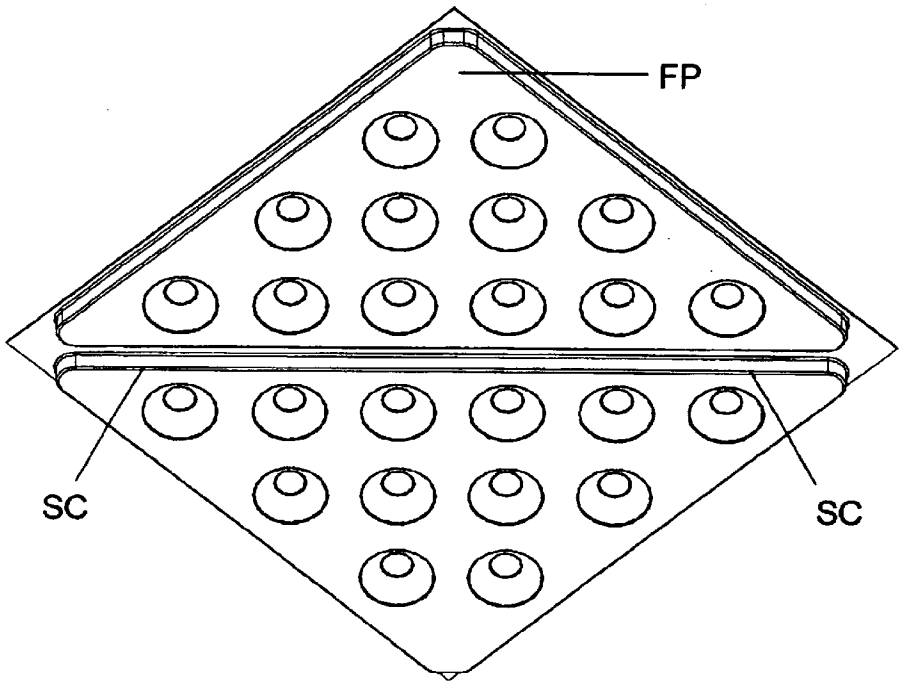
FIG. 12 shows the under side of a full panel. The stringer channel (SC) fits over two adjacent side stringers of two adjacent Modules.
Figure 13:
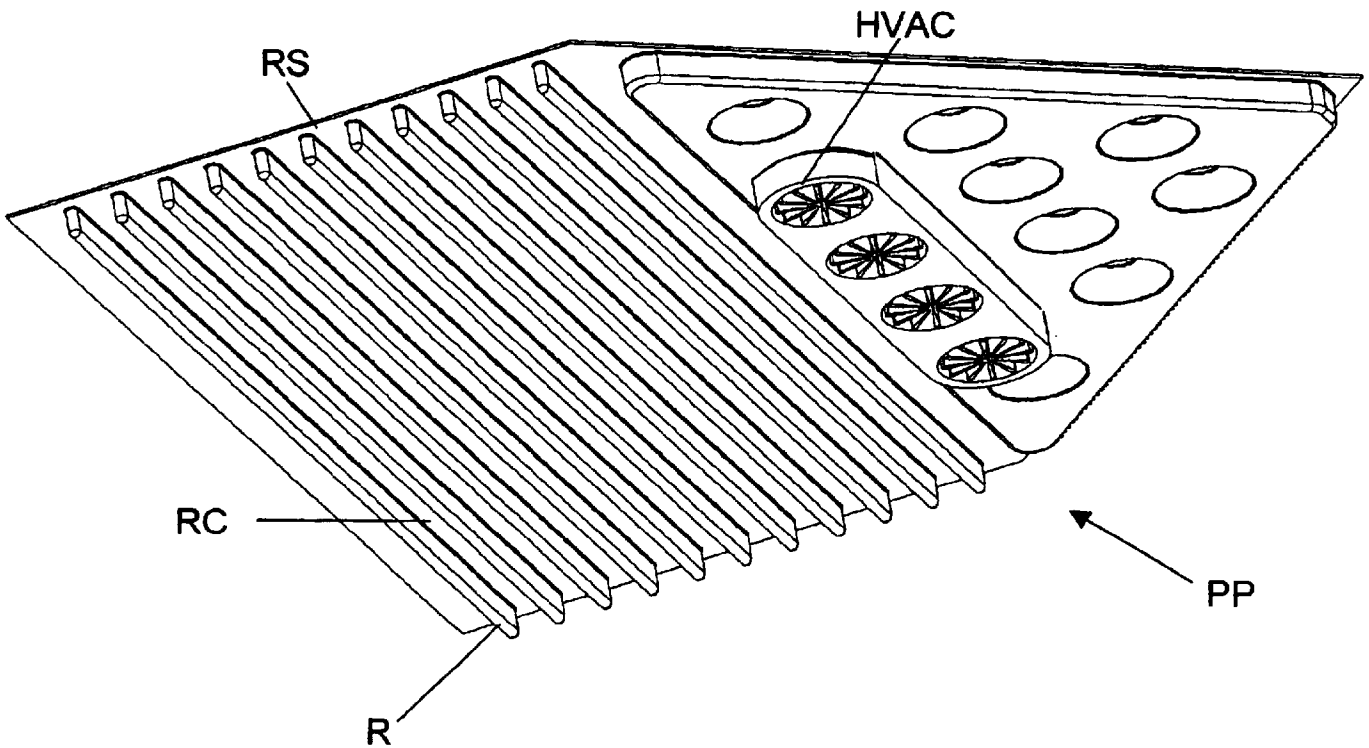
FIG. 13 shows the underside of a perimeter panel with air supply diffuser (HVAC). The rectangular section (RS) can cut along any line parallel to ribs R. The perimeter panel is then lowered onto the perimeter stringer frame which fits into the last remaining complete rib channel (RC).
Figure 14:
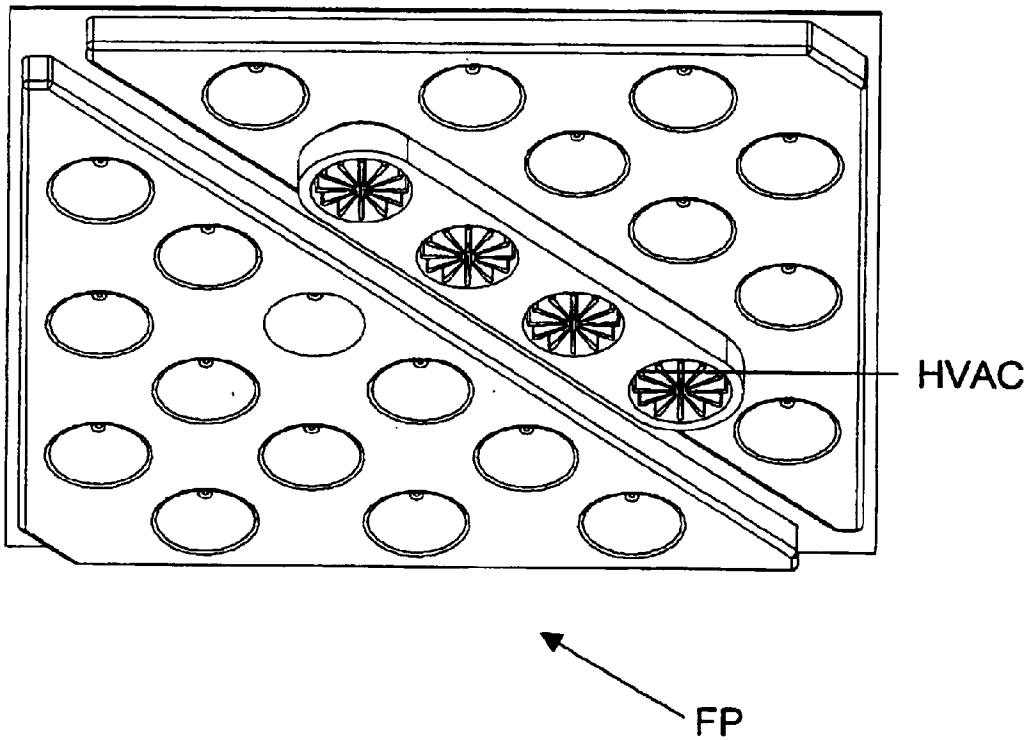
FIG. 14 shows the underside of a full panel with air supply diffuser (HVAC).
Figure 15:
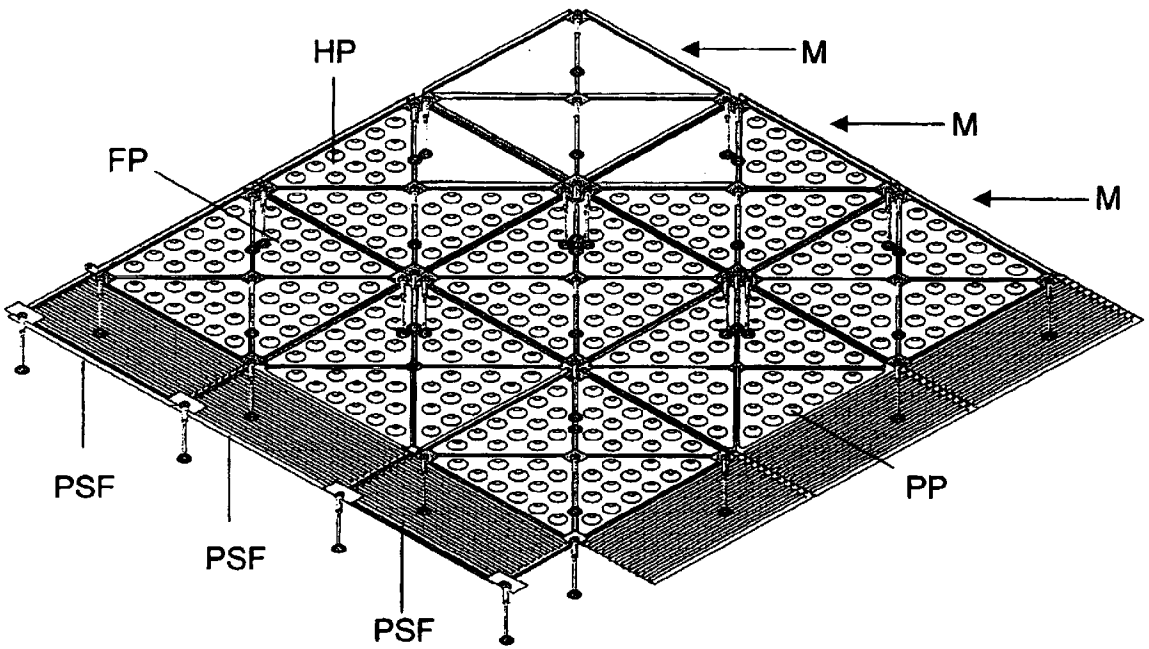
FIG. 15 shows a 3×3 Module array, plus three perimeter stringer frames, complete with all Modules and panels installed except for two full panels and two half panels.
Figure 16:
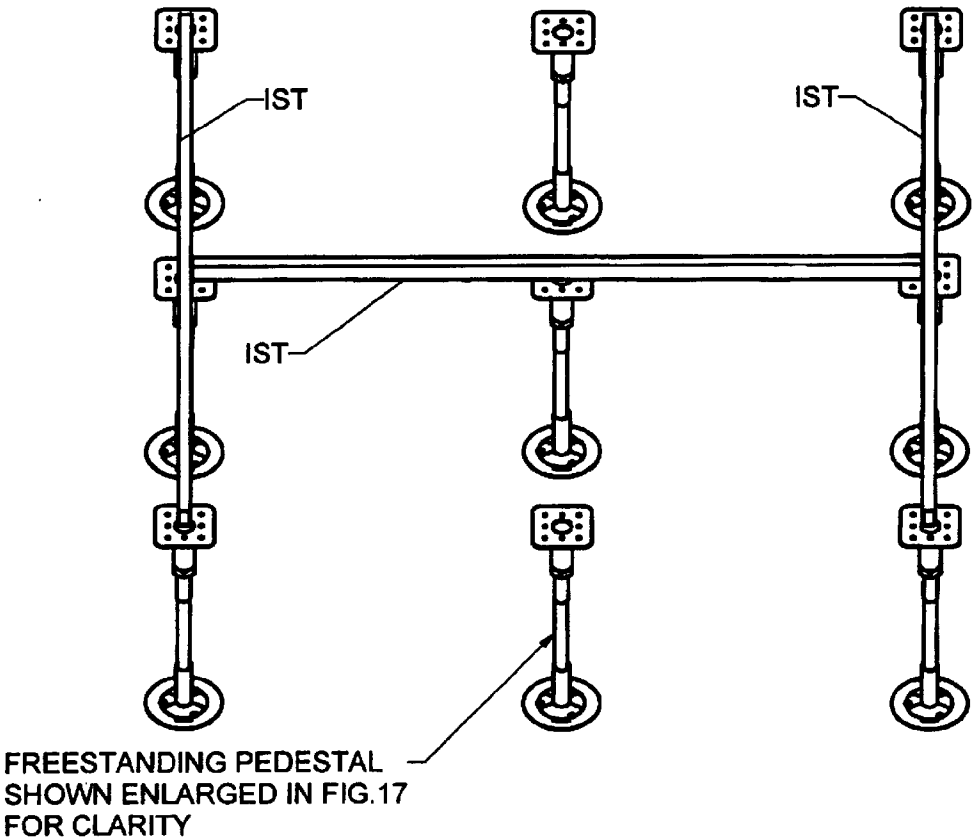
FIG. 16 shows an array of nine(9) freestanding pedestals (FP) designed to mate with a FSSMPCLGEL. Once the array is leveled by the FSSMPCLGEL at a required elevation, industry standard stringers (IST) can be screw fastened. Shown here are three(3) industry standard stringers. Industry standard panels, of which a section is shown in FIG. 1., can be screw fastened directly to the top of the FP with or without stringers, both fastening methods being customary practice with the prior art.
Figure 17:
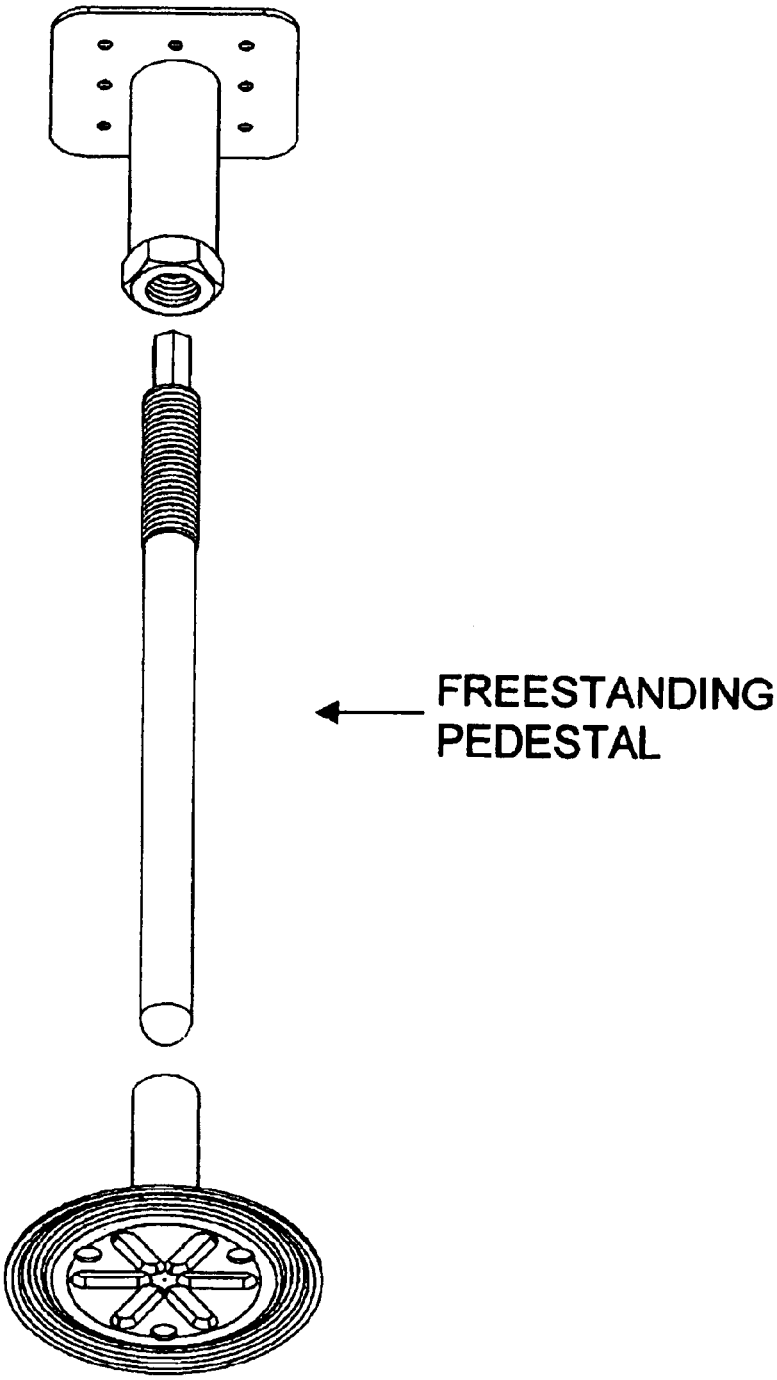
FIG. 17 shows a freestanding pedestal (FP) in an exploded perspective which depicts the inner workings as being the functionally equivalent to those shown in FIG. 7. One or more FP's mates with a FSSMPCLGEL allowing single free standing pedestal(FP) leveling or simultaneous multiple free standing pedestal(FP's) leveling of any logical array of (FP's).
Figure 18:
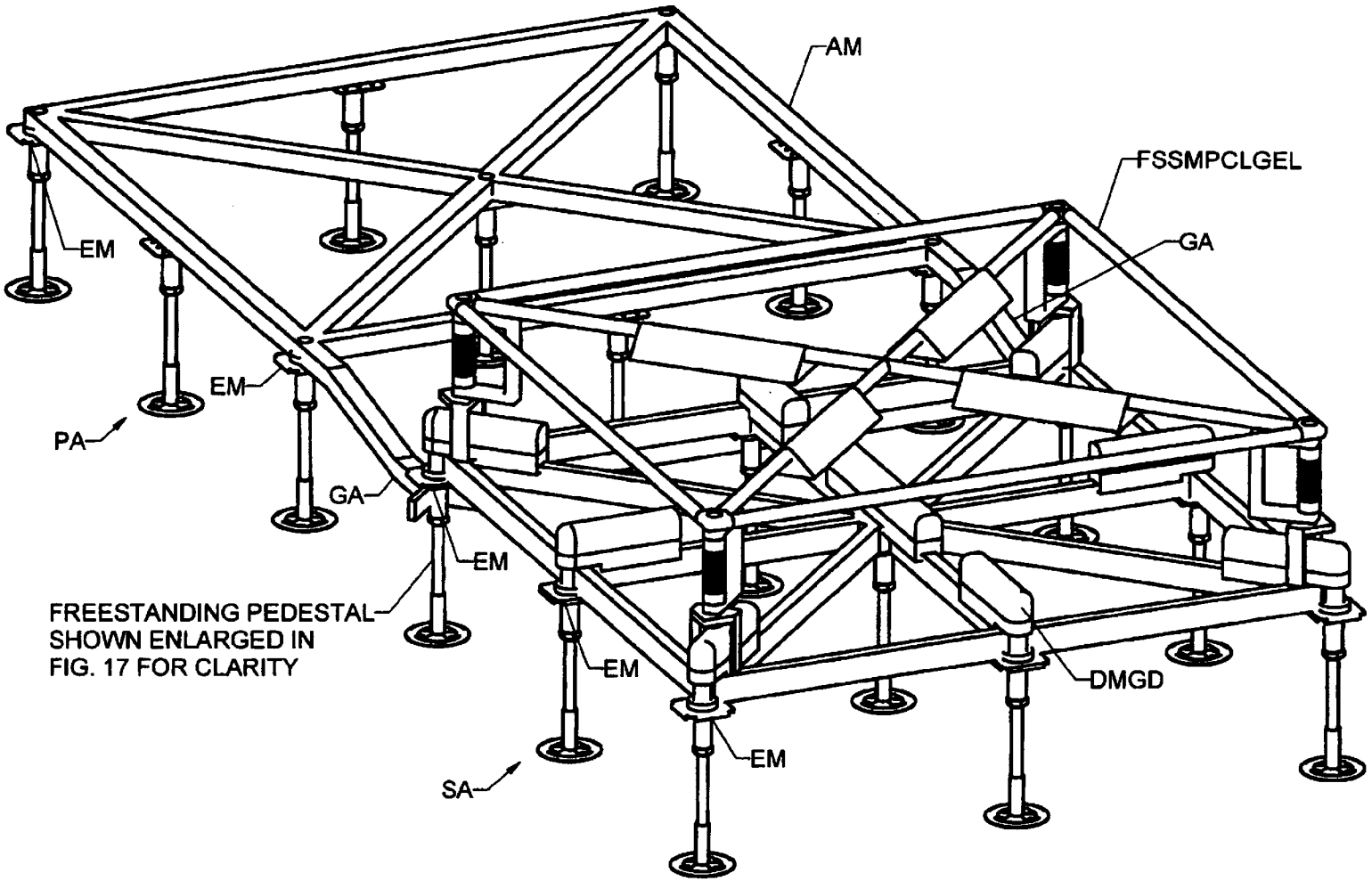
FIG. 18 shows a FSSMPCLGEL on top of a successive array (SA) of nine freestanding pedestals (FP) in their installation, leveling and elevating mode. The unitized pedestals in this figure are of a different design that employs the same operating function as the unitized pedestal of this invention except that the leg and plate are of a lower profile and larger diameter, respectively, to facilitate stability and adhesion to the subfloor. Each of the nine motor drives of the FSSMPCLGEL is surrounded by an electromagnetic holding plate (EM) which when electrified, firmly holds each freestanding pedestal to the FSSMPCLGEL. The prior array (PA) of nine freestanding pedestals are fully installed, leveled and elevated. The prior array of freestanding pedestals is firmly stabilized on the subfloor by the aligning template (AM) which is fitted with the same array of electromagnetic holding plates as the array of like plates on the FSSMPCLGEL. The electromagnetically integrated combination of pedestals and aligning template, provides a stable assembly for the accurate location and installation of a successive array of—in this example—nine freestanding pedestals. Cantilevered guide arms (GA) of the template extending beyond the template array serve as guides fore accurate alignment and placement of each successive array of freestanding pedestals held on the FSSMPCLGEL.

What it claimed is:

1. A unitized, pre-fabricated access floor arrangement comprising:

a. a quadrilateral modular stringer frame comprising four exterior sides and four diagonal interior sides of equal length, four corner pedestal joining means each connecting two exterior sides and two diagonal interior sides and comprising an indented top surface and a threaded perforation placed at the center of place where the exterior sides connect, and one diagonal pedestal joining means, said diagonal pedestal joining means placed at the center of the modular stringer frame and connecting the four diagonal interior sides and comprising an indented top surface and a threaded perforation placed at the center of place where the four diagonal sides connect;

b. a plurality of leveling pedestals for vertical leveling of the modular stringer frame, each leveling pedestal comprising an upper housing, a traveling threaded male column and a foot, the upper housing further comprising an attaching means end, a threaded interior and a bottom end, the threaded male column further comprising a top end, a bottom end and a threaded surface, the foot further comprising an attaching means;

c. a corner locking device comprising a flat plate and four attaching means, said flat plate further comprising four perforations, said flat plate shaped to sit on a top surface created by the four corner pedestal joining means of four modular stringer frames placed immediately adjacent to each other with the perforations of said plate geometrically distributed to match the perforations of the four corner pedestal joining means;

d. a floor panel comprising a top surface and an underside, the underside comprising a diagonal indentation shaped so that the floor panel can be placed over a modular stringer frame and used to physically hold together two neighboring modular stringer frames by allowing the diagonal indentation to straddle two adjacent exterior sides of two neighboring modular stringer frames;

e. a plurality of heating, ventilating and air conditioning diffusers which can be structurally integrated with individual floor panels as needed;

f. a plurality of cable trays that can be hung from selected stringer frames to form cable chase ways in the space between a subfloor and the underside of the panel to guide power, voice and data cables; and g. a plurality of plenum dividers that can be inserted in a space created between the stringer frame and the subfloor in order to establish heating, ventilating and air conditioning zones.

2. The unitized, pre-fabricated access floor arrangement according to claim 1 wherein the leveling pedestals are hingedly attached to the modular stringer frame before delivery to an installation site so that the pedestal can swing into a position perpendicular to the modular stringer frame for installation or retract to the horizontal plane of the modular stringer frame for storage or transportation.

3. A unitized, pre-fabricated access floor arrangement according to claim 1 wherein the modular stringer frame does not comprise diagonal interior sides.

4. A unitized, pre-fabricated access floor arrangement according to claim 1 wherein a plurality of adjacent modular stringer frames comprise alternating diagonal interior sides.

5. The unitized, pre-fabricated access floor arrangement according to claim 1 wherein the modular stringer frame comprises three exterior sides and no diagonal interior sides.

6. An access floor leveling tool comprising:

a. a stringer housing frame having the same horizontal geometry as, but greater in height than, the modular stringer frame, said stringer housing frame having a top side and a bottom side;

b. a control box capable of presetting a desired elevation of the access floor arrangement;

c. a plurality of sockets geometrically placed to mechanically mate with the top end of the threaded male column of the leveling pedestal through the corner pedestal joining means and the diagonal pedestal joining means;

d. a variable speed, bi-directional electric motor mechanically attached to the top side of the stringer housing frame comprising a plurality of motor drives, each motor drive capable of rotating each socket mated to a threaded male column;

e. a standard tripod-mounted rotating laser beam transmitter placed on the subfloor and capable of sending a level laser beam at a preset elevation;

f. a plurality of laser and torque sensors equipped with a computerized microprocessor capable of independently actuating and controlling the electric motor to rotate each of the sockets while each socket is mated with the top end of each of the leveling pedestal's threaded male column through the corner pedestal joining means and the diagonal pedestal joining means;

g. light emitting means mounted on the top side of the stringer frame housing capable of enhancing worker sighting and accurate manipulation of the access floor leveling tool;

h. a leveling pedestal holding device placed around each motor drive capable of holding each leveling pedestal attached to the access floor leveling tool; and i. a template comprising a three-dimensional rigid frame of the same horizontal geometry as the access floor leveling tool, and further comprising a plurality of leveling pedestal holding devices.

7. A method to install a unitized, pre-fabricated access floor arrangement comprising:

a. snapping two corner chalk lines at a layout starting corner of each major area of a sub-floor to be fitted with the access floor arrangement of this invention;

b. setting up a plurality of standard tripod-mounted rotating laser beam emitters on the subfloor;

c. setting up the laser beam emitters' elevation to match the desired elevation of the top surface of the floor panel and the vertical distance between the top surface of the floor panel and the center of each tool laser sensor's height d. assembling the modular stringer frame by joining plurality of stringer pieces in a quadrilateral configuration;

e. assembling the leveling pedestal by inserting the bottom end of the threaded male column into the foot and the threading male column into the bottom end of the upper housing so that the upper housing's threaded interior allows the height of leveling pedestal to be controlled by rotating the threaded male column attached to the foot;

f. attaching a plurality of leveling pedestals to the pedestal joining means by mechanically engaging the attaching means of the upper housing to the joining means to form a module so that the height and level of the module can be controlled by mechanically varying the height of the leveling pedestals;

g. inverting and carrying the module to the layout starting corner and placing the module on the sub-floor with two of the module's corner sides precisely aligned with the perpendicular corner chalk lines;

h. placing the leveling tool on the module lowering and guiding the leveling tool until the sockets physically engage with the top end of the traveling threaded column of the leveling pedestal through the joining means;

i. pre-setting the control box to the desired module elevation;

j. activating the control box to actuate the sockets so that the sockets rotate the threaded male column sufficiently to level the pedestals to the preset elevation of the Module;

k. repeating steps a-j until one complete row of modules is assembled in any given direction;

l. completing additional rows of modules until an entire subfloor is covered with an array of modules, excepting any irregular width perimeters around building cores, interior columns and exterior walls;

m. as each set of four adjacent modules are assembled forming a square array, inserting and locking the corner locking device;

n. installing modules using specially made stringer frames to fit the perimeter width dimensions;

o. randomly placing floor panels equipped with heating, ventilation and air conditioner diffusers in the array of modules, and relocating said panels at a later time according to occupancy, heating, ventilating and air conditioning needs;

p. hanging the cable trays from the stringer frames as dictated by occupancy and use of the access floor assembly and according to power, voice and data system requirements; and q. inserting plenum dividers under and along any modular stringer frame member between the member and the subfloor so that HVAC zones can be established; and r. placing the underside of a plurality of floor panels on the top surface of the array of modules, so that each floor panel physically holds together two neighboring modular stringers by allowing the diagonal indentation on the floor panel's underside to straddle two adjacent exterior sides of two neighboring modular stringers.

8. The method of claim 7 to install a unitized, pre-fabricated access floor arrangement further comprising:

a. setting the access floor leveling tool on the subfloor so that the bottom side of the stringer housing frame is exposed;;

b. placing a plurality of leveling pedestal holding devices around each motor drive;

c. engaging each attaching means end of a plurality of leveling pedestals to the bottom side of the stringer housing frame so that each pedestal is mated with a corresponding tool drive socket;

d. applying an adhesive means to the bottom of the foot of each pedestal;

e. placing the access floor leveling tool with the engaged pedestals on a pre-determined location on the subfloor so that the bottom of the foot of each pedestal is adhesively attached to the subfloor;

f. actuating the access floor leveling tool so that the plurality of pedestals are leveled to a pre-determined position;

g. releasing and removing the leveling tool from the pedestals;

h. placing the template on the plurality of already leveled pedestals, i. actuating the template's pedestal holding devices resulting in a firm and stable assembly of template and pedestals attached to the subfloor; and j. using the assembly of template and pedestals as a physical datum for guiding the precise placement of successive arrays of pedestals.

9. The method to install a unitized, pre-fabricated access floor arrangement according to claim 8 wherein the leveling pedestal holding device is electro-mechanically held in place around each motor drive.

10. A method to install a unitized, pre-fabricated access floor arrangement according to claim 8 wherein the leveling pedestal holding device is electro-magnetically held in place around each motor drive.

11. The method to install a unitized, pre-fabricated access floor arrangement according to claim 8 wherein the leveling pedestal holding device is mechanically held in place around each motor drive.

* * * * *